US006906673B1

(12) United States Patent
Matz et al.

(10) Patent No.: US 6,906,673 B1
(45) Date of Patent: Jun. 14, 2005

(54) METHODS FOR ALIGNING AN ANTENNA WITH A SATELLITE

(75) Inventors: William R. Matz, Atlanta, GA (US); Timothy H. Weaver, Alpharetta, GA (US)

(73) Assignee: BellSouth Intellectual Property Corporation, Wilmington, DE (US)

( * ) Notice: Subject to any disclaimer, the term of this patent is extended or adjusted under 35 U.S.C. 154(b) by 317 days.

(21) Appl. No.: 10/302,023

(22) Filed: Nov. 22, 2002

Related U.S. Application Data

(62) Division of application No. 09/751,278, filed on Dec. 29, 2000.

(51) Int. Cl.[7] ..... H01Q 3/00
(52) U.S. Cl. ..... 343/760; 343/878; 343/894
(58) Field of Search ..... 343/757, 760, 343/765, 766, 878, 880, 882, 894

(56) References Cited

U.S. PATENT DOCUMENTS

| | | | | |
|---|---|---|---|---|
| 110,434 | A | 12/1870 | Clarke | 248/515 |
| 780,947 | A | 1/1905 | Grabe | 403/386 |
| 1,303,249 | A | 5/1919 | Brown | 248/70 |
| 1,522,751 | A | 1/1925 | Sechier | 172/721 |
| 1,935,246 | A | 11/1933 | Kirsch | 403/205 |
| 2,463,176 | A | 3/1949 | Hogrefe | 248/682 |
| 2,575,917 | A | 11/1951 | Johnson | 403/59 |
| 2,611,566 | A | 9/1952 | Landis | 248/536 |
| 2,614,861 | A | 10/1952 | Van Horn | 260/457 |
| 2,667,317 | A | 1/1954 | Trebules | 248/514 |
| 2,754,156 | A | 7/1956 | Elderkin | 403/98 |
| 3,910,561 | A | 10/1975 | Fornells | 256/65 |
| 3,941,340 | A | 3/1976 | Rankins | 248/40 |
| 4,095,230 | A | 6/1978 | Salmond et al. | 343/7.29 |
| 4,126,865 | A | 11/1978 | Longhurst et al. | 343/766 |
| 4,237,465 | A | 12/1980 | Shibano et al. | 343/894 |
| 4,258,568 | A | 3/1981 | Boetes et al. | 73/170 A |
| 4,495,706 | A | 1/1985 | Kaminski | 33/333 |
| 4,626,864 | A | 12/1986 | Micklethwaite | 343/766 |
| 4,691,207 | A | 9/1987 | Timineri | 343/766 |
| 4,726,259 | A | 2/1988 | Idler | 74/785 |
| 4,833,932 | A | 5/1989 | Rogers | 74/5.1 |

(Continued)

FOREIGN PATENT DOCUMENTS

| | | |
|---|---|---|
| EP | 1 014 481 A1 | 6/2000 |
| WO | 00/24083 A1 | 4/2000 |

OTHER PUBLICATIONS

U.S. Appl. No. 10/364,099, filed date unknown, inventor Matz et al.
U.S. Appl. No. 10/014,284, filed date unknown, inventor Matz et al.
U.S. Appl. No. 10/014,285, filed date unknown, inventor Matz et al.
U.S. Appl. No. 10/008,424, filed date unknown, inventor Saunders et al.
U.S. Appl. No. 10/350,655, filed date unknown, inventor Watson.
U.S. Appl. No. 09/467,574, filed date unknown, inventor McDonald.

*Primary Examiner*—Hoang V. Nguyen
(74) *Attorney, Agent, or Firm*—Kirkpatrick & Lockhart LLP

(57) ABSTRACT

Methods for aligning a satellite reflector with an antenna. One method includes the use of an antenna-alignment device to orient the centerline of an antenna in a desired azimuth, elevation and skew orientation. Another method includes the use of an antenna alignment device that is attached to the antenna and can be used in conjunction with a set top box attached to the antenna without the installer having to make trips between the antenna and the television to which the set top box is also attached. Yet other methods include the alignment of an antenna with a satellite wherein the antenna is supported by an adjustable mounting bracket.

28 Claims, 29 Drawing Sheets

U.S. PATENT DOCUMENTS 4,990,924 A 2/1991 McMullen et al. ..... 342/359
5,065,969 A 11/1991 McLean ..... 248/282
5,088,672 A 2/1992 Neuendorf et al. ..... 248/230
5,138,651 A 8/1992 Sudo ..... 379/61
5,276,972 A 1/1994 Staney ..... 33/271
5,351,060 A 9/1994 Bayne ..... 343/766
5,376,941 A 12/1994 Fukazawa et al. ..... 342/359
5,448,254 A 9/1995 Schneeman et al. .... 343/781 R
5,463,403 A 10/1995 Walker et al. ..... 342/359
5,469,182 A 11/1995 Chaffee ..... 343/882
5,473,335 A 12/1995 Tines ..... 343/766
5,561,433 A 10/1996 Chaney et al. ..... 342/359
5,589,837 A 12/1996 Soleimani et al. ..... 342/359
5,621,418 A 4/1997 Maloney ..... 343/742
5,646,638 A 7/1997 Winegard et al. ..... 343/882
5,647,134 A 7/1997 Chou ..... 33/355 R
5,657,031 A 8/1997 Anderson et al. ..... 343/757
5,664,752 A 9/1997 Matthiessen et al. .... 248/299.1
5,734,356 A 3/1998 Chang ..... 343/882
5,760,739 A 6/1998 Pauli ..... 342/359
5,764,186 A 6/1998 Yoo ..... 342/359
5,829,121 A 11/1998 Shoemaker et al. ..... 291/600
5,870,059 A 2/1999 Reynolds ..... 343/760
5,884,199 A 3/1999 Maki ..... 455/575
5,894,674 A 4/1999 Feldman ..... 33/354
5,903,237 A 5/1999 Crosby et al. ..... 342/359
5,915,020 A 6/1999 Tilford et al. ..... 380/10
5,920,291 A 7/1999 Bosley ..... 343/892
5,923,288 A 7/1999 Pedlow, Jr. ..... 342/359
5,933,123 A 8/1999 Kaul ..... 343/879
5,940,028 A 8/1999 Iwamura ..... 342/359
5,945,945 A 8/1999 Wagner et al. ..... 342/359
D413,603 S 9/1999 Inoue
5,977,922 A 11/1999 Hemmingsen, II ..... 343/760
5,992,809 A 11/1999 Sweere et al. ..... 248/278.1
5,999,139 A 12/1999 Benjamin et al. ..... 343/765
6,008,769 A 12/1999 Palmiter et al. ..... 343/766
6,011,511 A 1/2000 Chuong et al. ..... 342/359
6,023,247 A 2/2000 Rodeffer ..... 343/765
6,031,508 A 2/2000 Ishizuka et al. ..... 343/882
6,037,913 A 3/2000 Johnson ..... 343/882
6,188,372 B1 2/2001 Jackson et al. ..... 343/882
6,208,314 B1 3/2001 Bourquin ..... 343/872
6,216,266 B1 4/2001 Eastman et al. ..... 725/72
6,229,480 B1 5/2001 Shintani ..... 342/359
6,262,687 B1 7/2001 Bai et al. ..... 343/757
6,285,338 B1 9/2001 Bai et al. ..... 343/2
6,331,839 B1 12/2001 Grenell ..... 343/840
D453,151 S 1/2002 Weaver
6,337,658 B1 1/2002 Tong et al. ..... 342/359
D453,330 S 2/2002 Weaver
6,480,161 B2 11/2002 Watson ..... 343/766
6,484,987 B2 11/2002 Weaver ..... 248/278.1
6,486,851 B2 11/2002 Weaver ..... 343/878
6,507,325 B2 1/2003 Matz et al. ..... 343/878
6,559,806 B1 5/2003 Watson ..... 343/766
6,580,391 B1 6/2003 Kepley et al. ..... 342/359
6,683,581 B2 1/2004 Matz et al. ..... 343/760
2002/0083573 A1 7/2002 Matz et al. ..... 29/600
2002/0083574 A1 7/2002 Matz et al. ..... 29/600
2002/0084941 A1 7/2002 Matz et al. ..... 343/760
2002/0084946 A1 7/2002 Matz et al. ..... 343/878

METHODS FOR ALIGNING AN ANTENNA WITH A SATELLITE

CROSS-REFERENCE TO RELATED APPLICATIONS

This application is a division of U.S. patent application Ser. No. 09/751,278 filed Dec. 29, 2000.

BACKGROUND OF THE INVENTION

1. Field of the Invention

The subject invention relates to alignment devices and methods and, more particularly, to devices and methods for aligning an antenna with a satellite.

2. Description of the Invention Background

The advent of the television can be traced as far back to the end of the nineteenth century and beginning of the twentieth century. However, it wasn't until 1923 and 1924, when Vladimir Kosma Zworykin invented the iconoscope, a device that permitted pictures to be electronically broken down into hundreds of thousands of components for transmission, and the kinescope, a television signal receiver, did the concept of television become a reality. Zworykin continued to improve those early inventions and television was reportedly first showcased to the world at the 1939 World's Fair in New York, where regular broadcasting began.

Over the years, many improvements to televisions and devices and methods for transmitting and receiving television signals have been made. In the early days of television, signals were transmitted via terrestrial radio networks and received through the use of antennas. Signal strength and quality, however, were often dependent upon the geography of the land between the transmitting antenna and the receiving antenna. Although such transmission methods are still in use today, the use of satellites to transmit television signals is becoming more prevalent. Because satellite transmitted signals are not hampered by hills, trees, mountains, etc., such signals typically offer the viewer more viewing options and improved picture quality. Thus, many companies have found offering satellite television services to be very profitable and, therefore, it is anticipated that more and more satellites will be placed in orbit in the years to come. As additional satellites are added, more precise antenna/satellite alignment methods and apparatuses will be-required.

Modern digital satellite communication systems typically employ a ground-based transmitter that beams an uplink signal to a satellite positioned in geosynchronous orbit. The satellite relays the signal back to ground-based receivers. Such systems permit the household or business subscribing to the system to receive audio, data and video signals directly from the satellite by means of a relatively small directional receiver antenna. Such antennas are commonly affixed to the roof or wall of the subscriber's residence or are mounted to a tree or mast located in the subscriber's yard. A typical antenna constructed to received satellite signals comprises a dish-shaped reflector that has a support arm protruding outward from the front surface of the reflector. The support arm supports a low noise block amplifier with an integrated feed "LNBF". The reflector collects and focuses the satellite signal onto the LNBF which is connected, via cable, to the subscriber's television.

To obtain an optimum signal, the antenna must be installed such that the centerline axis of the reflector, also known as the "bore site" or "pointing axis", is accurately aligned with the satellite. To align an antenna with a particular satellite, the installer must be provided with accurate positioning information for that particular satellite. For example, the installer must know the proper azimuth and elevation settings for the antenna. The azimuth setting is the compass direction that the antenna should be pointed relative to magnetic north. The elevation setting is the angle between the Earth and the satellite above the horizon. Many companies provide installers with alignment information that is specific to the geographical area in which the antenna is to be installed. Also, as the satellite orbits the earth, it may be so oriented such that it sends a signal that is somewhat skewed. To obtain an optimum signal, the antenna must also be adjustable to compensate for a skewed satellite orientation.

The ability to quickly and accurately align the centerline axis of antenna with a satellite is somewhat dependent upon the type of mounting arrangement employed to support the antenna. Prior antenna mounting arrangements typically comprise a mounting bracket that is directly affixed to the rear surface of the reflector. The mounting bracket is then attached to a vertically oriented mast that is buried in the earth, mounted to a tree, or mounted to a portion of the subscriber's residence or place of business. The mast is installed such that it is plumb (i.e., relatively perpendicular to the horizon). Thereafter, the installer must orient the antenna to the proper azimuth and elevation. These adjustments are typically made at the mounting bracket. Prior mounting brackets commonly employ a collection of bolts that must first be loosened to permit the antenna to be adjusted in one of the desired directions. After the installer initially positions the antenna in the desired position, the locking bolts for that portion of the bracket are tightened and other bolts are loosened to permit the second adjustment to be made. It will be appreciated that the process of tightening the locking bolts can actually cause the antenna to move out of its optimum position which can deteriorate the quality of the signal or, in extreme situations, require the installer to re-loosen the bolts and begin the alignment process over again. Furthermore, such mounting apparatuses cannot accommodate relatively fine adjustments to the antenna. In addition, because such crude bracket arrangements are attached directly to the rear of the reflector, they can detract from the reflector's aesthetic appearance.

One method that has been employed in the past for indicating when the antenna has been positioned at a proper azimuth orientation is the use of a compass that is manually supported by the installer under the antenna's support arm. When using this approach however, the installer often has difficulty elevating the reflector to the proper elevation so that the antenna will be properly aligned and then retaining the antenna in that position while the appropriate bolts and screws have been tightened. The device disclosed in U.S. Pat. No. 5,977,922 purports to solve that problem by affixing a device to the support arm that includes a compass and a inclinometer. In this device, the support arm can move slightly relative to the reflector and any such movement or misalignment can contribute to pointing error. Furthermore, devices that are affixed to the support arm are not as easily visible to the installer during the pointing process. In addition, there are many different types and shapes of support arms which can require several different adapters to be available to the installer. It will also be understood that the use of intermediate adapters could contribute pointing error if they do not interface properly with the support arm.

Another method that has been used in the past to align the antenna with a satellite involves the use of a "set top" box that is placed on or adjacent to the television to which the antenna is attached. A cable is connected between the set top box and the antenna. The installer initially points the antenna in the general direction of the satellite, then fine-tunes the alignment by using a signal strength meter displayed on the television screen by the set top box. The antenna is adjusted until the onscreen meter indicates that signal strength and quality have been maximized. In addition to the onscreen display meter, many set top boxes emit a repeating tone. As the quality of the signal improves, the frequency of the tones increases. Because the antenna is located outside of the building in which the television is located, such installation method typically requires two individuals to properly align the antenna. One installer positions the antenna while the other installer monitors the onscreen meter and the emitted tones. One individual can also employ this method, but that person typically must make multiple trips between the antenna and the television until the antenna is properly positioned. Thus, such alignment methods are costly and time consuming.

In an effort to improve upon this shortcoming, some satellite antennas have been provided with a light emitting diode ("LED") that operates from feedback signals fed to the antenna by the set top box through the link cable. The LED flashes to inform the installer that the antenna has been properly positioned. It has been noted, however, that the user is often unable to discern small changes in the flash rate of the LED as antenna is positioned. Thus, such approach may result in antenna being positioned in a orientation that results in less than optimum signal quality. Also, this approach only works when the antenna is relative close to its correct position. It cannot be effectively used to initially position the antenna. U.S. Pat. No. 5,903,237 discloses a microprocessor-operated antenna pointing aid that purports to solve the problems associated with using an LED indicator to properly orient the antenna.

Such prior antenna mounting devices and methods do not offer a relatively high amount of alignment precision. Furthermore, they typically require two or more installers to complete the installation and alignment procedures. As additional satellites are sent into space, the precision at which an antenna is aligned with a particular satellite becomes more important to ensure that the antenna is receiving the proper satellite signal and that the quality of that signal has been optimized. It is also desirable to have an antenna alignment device that can be effectively used by one installer.

There is a need for a method for aligning an antenna with a satellite that can be quickly, accurately, and efficiently employed by one installer.

SUMMARY OF THE INVENTION

In accordance with one form of the present invention, there is provided a method for aligning an antenna with a satellite that includes removably attaching a compass to a rear portion of the antenna and moving the antenna to a position wherein the compass displays a reading that corresponds to a predetermined azimuth reading. Thereafter, the antenna is locked in that position. These methods can employ a digital compass or a non-digital compass.

Another embodiment of the invention comprises a method for aligning an antenna with a satellite that includes removably attaching a level to a rear portion of the antenna and orienting the antenna in a position wherein the level displays a reading that corresponds to a predetermined elevation reading. Thereafter, the antenna is locked in that position. These methods can employ a digital level and a non-digital level.

Another method for aligning an antenna with a satellite of the present invention comprises removably attaching a compass and a level to a rear portion of the antenna. Thereafter, the antenna is oriented about a first axis to a first orientation wherein the compass displays a reading that corresponds to a predetermined azimuth reading. The antenna is retained in that orientation about the first axis while it is further oriented about a second axis until the level displays a reading that corresponds to a predetermined elevation reading. The antenna is then retained in the second orientation about the second axis.

Another embodiment of the invention comprises a method of aligning a centerline of an antenna with a satellite, wherein the antenna has a feed/LNBF assembly that is electronically coupled to a set top box which is electronically coupled to a television that has a television speaker therein. The method further comprises affixing an audio speaker to the antenna and operating the set top box and television such that a series of tones are emitted from the television speaker which are indicative of the alignment of the antenna centerline with the satellite. The method also includes transmitting the series of tones to the audio speaker affixed to the antenna and positioning the antenna until the series of tones being transmitted to the speaker affixed to the antenna have a desired frequency.

Yet another method of the present invention comprises a method of aligning a centerline of an antenna with a satellite, wherein the antenna has a feed/LNBF assembly that is electronically coupled to a set top box which is electronically coupled to a television having a television speaker therein. The method includes removably attaching a compass, a level and a speaker to the antenna and orienting the antenna about a first axis to a first orientation wherein the compass displays a reading that corresponds to a predetermined azimuth reading. The antenna is then retained in the first orientation about the first axis. The antenna is also oriented about a second axis to a second orientation until the level displays a reading that corresponds to a predetermined elevation reading. The antenna is then retained in the second orientation about the second axis. The method also includes operating the set top box and television such that a series of tones are emitted from the television speaker which are indicative of the alignment of the antenna centerline with the satellite and transmitting the series of tones to the audio speaker affixed to the antenna. In addition, the method includes reorienting the antenna about the first and second axes as necessary to a final orientation wherein the series of tones being transmitted to the speaker affixed to the antenna have a desired frequency. The antenna is thereafter locked in the final orientation.

Another method of the present invention comprises a method for aligning an antenna with a satellite wherein the method includes removably attaching an alignment device that has first and second digital levels therein to the antenna, the first and second digital levels cooperating to display a reading indicative of the antenna's skew orientation. The method also includes orienting the antenna about a first axis to a first orientation wherein the first digital level displays a reading that corresponds to a predetermined elevation reading and retaining the antenna in the first orientation. In addition, the method includes further orienting the antenna to another position wherein the first and second digital levels produce a skew reading that corresponds to a predetermined skew reading and locking the antenna in the another position.

Another method of the present invention includes a method of aligning a centerline of an antenna with a satellite, wherein the antenna has a feed/LNBF assembly that is electronically coupled to a set top box which is electronically coupled to a television having a television speaker therein. The method includes removably attaching an alignment device that has a compass, a speaker, and first and second digital levels therein to the antenna. The first and second digital levels cooperate to display a reading indicative of the antenna's skew orientation. In addition, the method includes orienting the antenna about a first axis to a first orientation wherein the compass displays a reading that corresponds to a predetermined azimuth reading. The antenna is retained in the first orientation about the first axis. The antenna is also moved about a second axis to a second orientation until the first digital level displays a reading that corresponds to a predetermined elevation reading. The antenna is then retained in the second orientation about the second axis. The antenna is further oriented to a third orientation position wherein the first and second digital levels produce a skew reading that corresponds to a predetermined skew reading. The antenna is then retained in the third orientation. The set top box is then operated such that a series of tones are emitted from the television speaker which are indicative of the alignment of the antenna centerline with the satellite and those tones are transmitted to the audio speaker. The antenna is reoriented as necessary to a final orientation wherein the series of tones being transmitted to the speaker affixed to the antenna have a desired frequency and the antenna is locked in the final orientation.

Another method of the present invention comprises a method of aligning a centerline of an antenna with a satellite, wherein the antenna has a feed/LNBF assembly that is electronically coupled to a set top box which is electronically coupled to a television having a television speaker therein. The method includes mounting an adjustable mounting bracket to a structure. The adjustable mounting bracket has a first movable portion and a second movable portion that is attached to the first movable portion. An end of a mast is affixed to the antenna such that the mast is coaxially aligned with the centerline of the antenna. The other end of the mast is supported in the second movable portion of the adjustable mounting bracket. An alignment device that has a compass, a speaker, and first and second digital levels therein is attached to the antenna. The first and second digital levels cooperate to display a reading indicative of the antenna's skew orientation to the antenna. The first movable portion of the adjustable mounting bracket is moved about a first axis to a first position wherein the antenna is oriented in a first orientation wherein the compass displays a reading that corresponds to a predetermined azimuth reading. The first movable portion is retained in the first position. The second movable portion of the adjustable mounting bracket is moved about a second axis to a second position wherein the antenna is oriented in a second orientation wherein the first digital level displays a reading that corresponds to a predetermined elevation reading. The other end of the mast is rotated within the second portion of the adjustable mounting bracket until the antenna is in a third orientation wherein the first and second digital levels produce a skew reading that corresponds to a predetermined skew reading. The antenna is retained in the third orientation.

The set top box and television are operated to produce a series of tones from the television speaker which are indicative of the alignment of the antenna centerline with the satellite and those tones are transmitted to the audio speaker. The first and second movable portions and the mast within the second movable portion are repositioned as necessary to move the antenna to a final orientation wherein the series of tones being transmitted to the speaker affixed to the antenna have a desired frequency. The mast is then locked to the second movable portion and the first and second movable portions are locked to prevent further movement thereof.

It is a feature of the present invention to provide methods for quickly and efficiently aligning an antenna with a satellite such that the antenna receives and optimal signal from the satellite.

It is another feature of the present invention to provide methods having the above-mentioned attributes that can be efficiently used by one installer.

Accordingly, the present invention provides solutions to the shortcomings of prior methods for orienting antennas for receiving satellite signals. Those of ordinary skill in the art will readily appreciate, however, that these and other details, features and advantages will become further apparent as the following detailed description of the embodiments proceeds.

BRIEF DESCRIPTION OF THE DRAWINGS

In the accompanying Figures, there are shown present embodiments of the invention wherein like reference numerals are employed to designate like parts and wherein.

DETAILED DESCRIPTION OF THE EMBODIMENTS OF THE INVENTION

Figure 1:
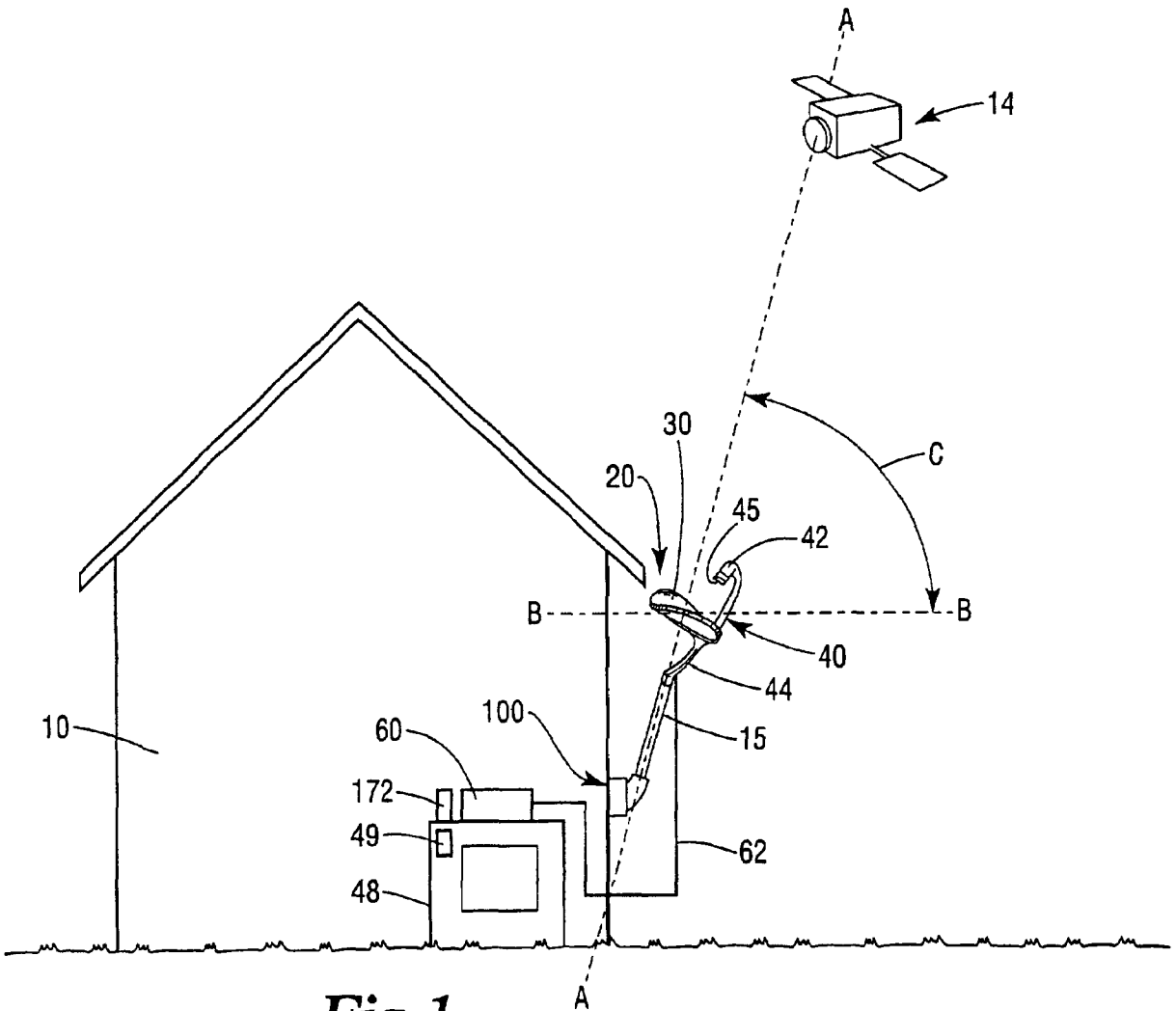
FIG. 1 is a graphical representation of an antenna attached to a building and aligned to receive a signal from a satellite.

Referring now to the drawings for the purposes of illustrating embodiments of the invention only and not for the purposes of limiting the same, FIG. 1 illustrates an antenna 20 that is attached to the wall of a residence or other building 10 by a mounting bracket 100. The antenna 20 is oriented to receive audio and video signals from a satellite 14 in geosynchronous orbit around the earth.

Figure 2:
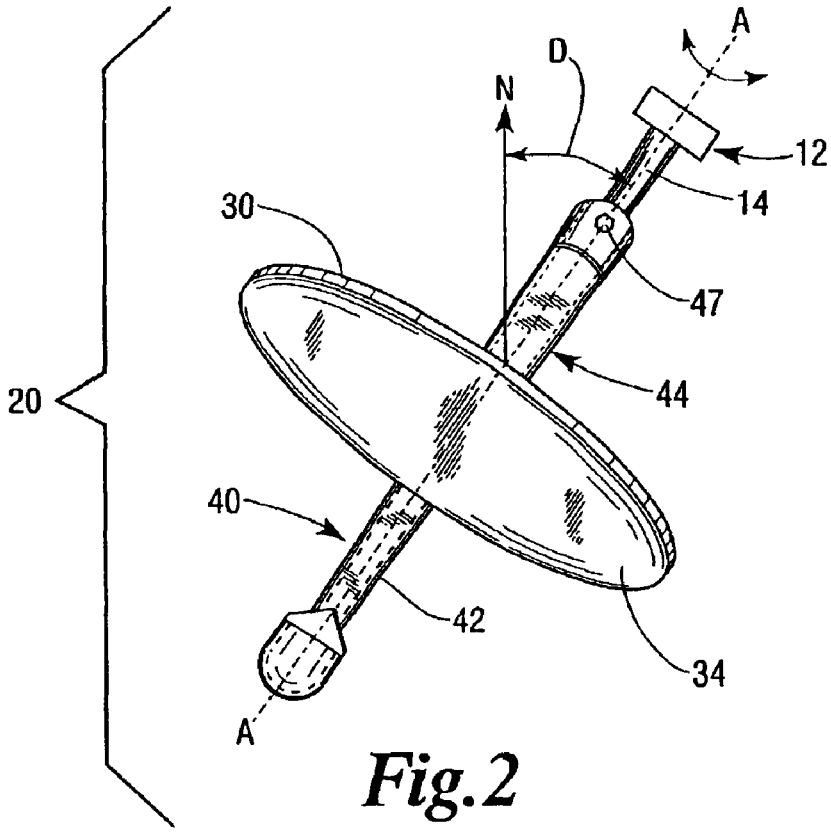
FIG. 2 is a plan view of an antenna attached to a mounting bracket.

Antenna 20 must be properly positioned to receive the television signals transmitted by the satellite 14 to provide optimal image and audible responses. This positioning process involves accurately aligning the antenna's centerline axis A—A, with the satellite's output signal. "Elevation", "azimuth" and "skew" adjustments are commonly required to accomplish this task. As shown in FIG. 1, elevation refers to the angle between the centerline axis A—A of the antenna relative to the horizon (represented by line B—B), generally designated as angle "C". In the antenna embodiment depicted in FIGS. 1 and 2, the elevation is adjusted by virtue of an elevation adjustment mechanism on the mounting bracket 100. As shown in FIG. 2, "azimuth" refers to the angle of axis A—A relative to the direction of true north in a horizontal plane. That angle is generally designated as angle "D" in FIG. 2. "Skew" refers to the angle of the antenna with respect to the centerline or boresite A—A.

Figure 4:
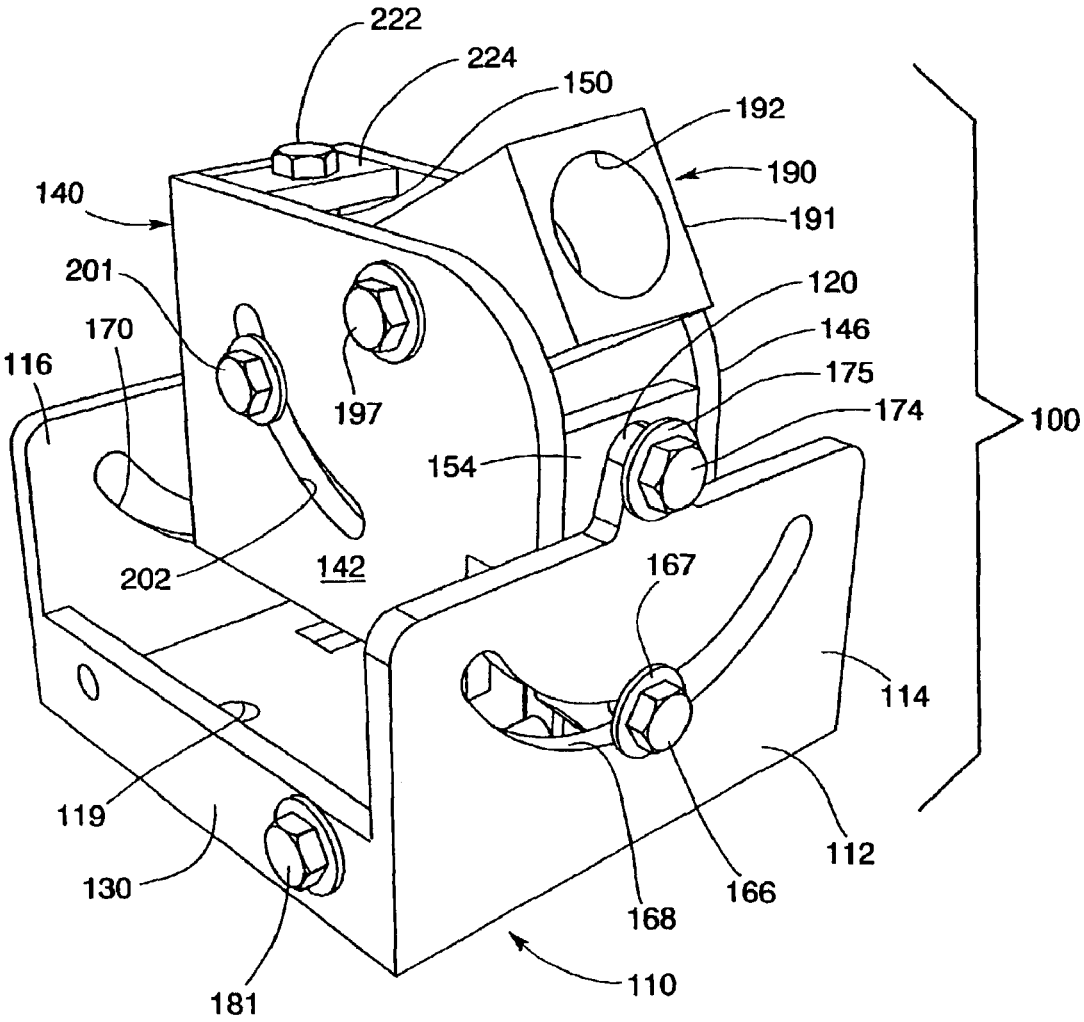
FIG. 4 is a perspective view of a mounting bracket.
Figure 5:
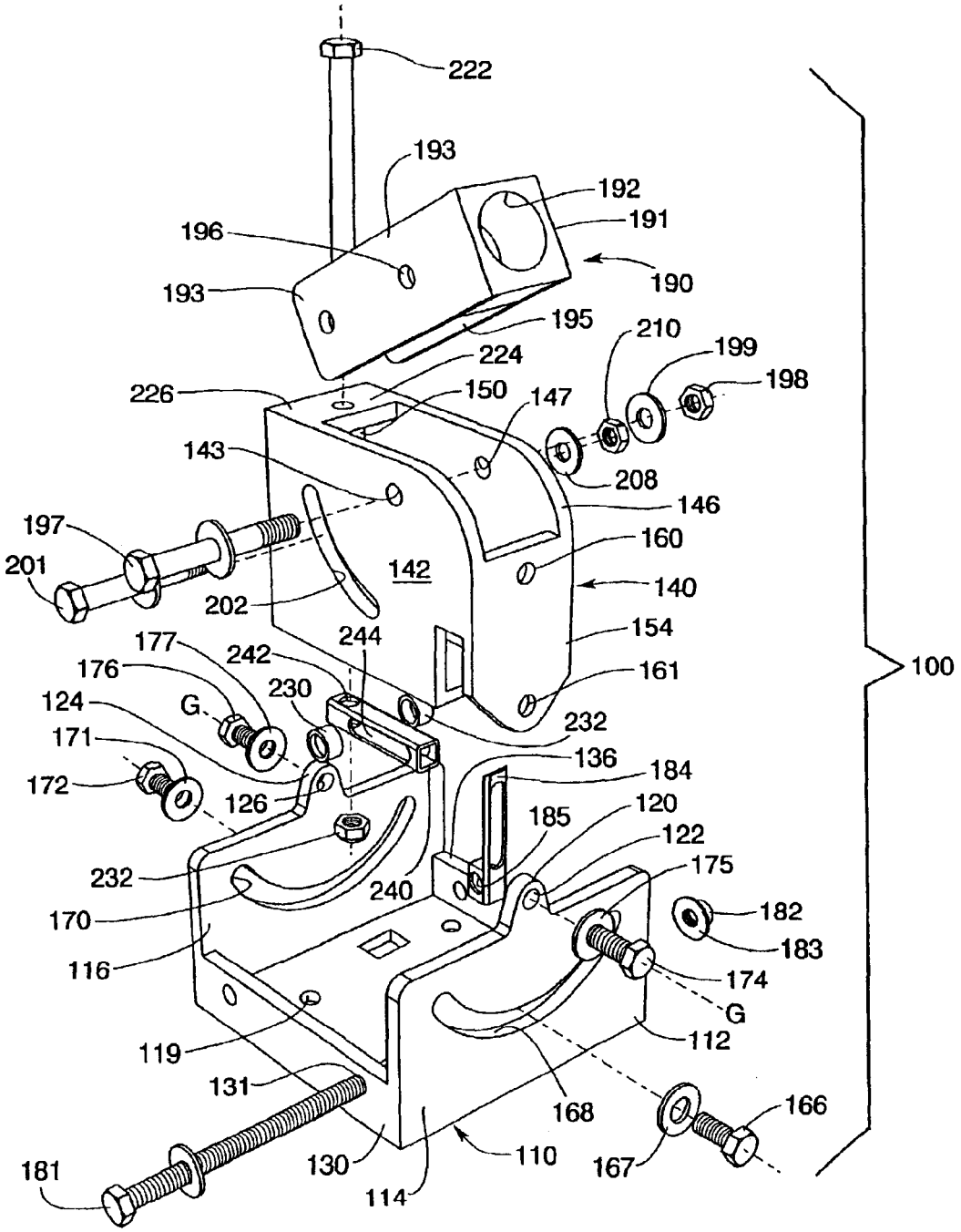
FIG. 5 is an exploded assembly view of the mounting bracket depicted in FIG. 4.
Figure 6:
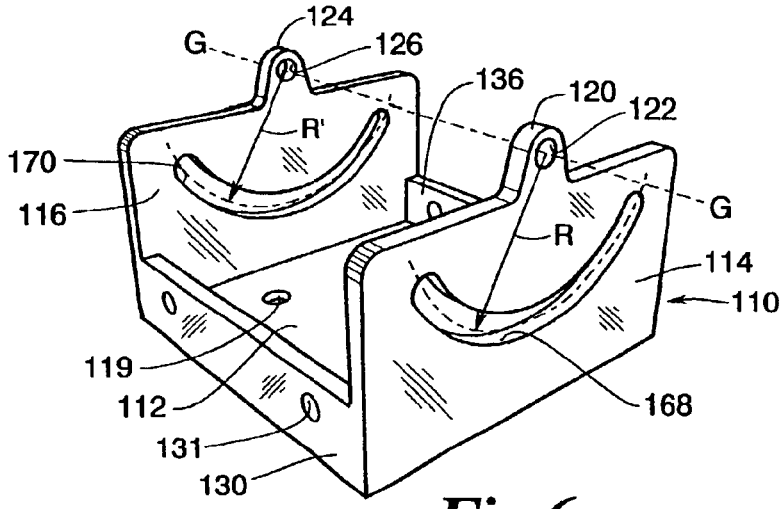
FIG. 6 is a perspective view of a mounting member of the mounting bracket in FIGS. 4 and 5.

Turning to FIGS. 4–6, the mounting bracket 100 includes a mounting member 110 that has a rear portion 112, a top portion 114 and a bottom portion 116. The portions of mounting member 110 may be fabricated from metal, such as aluminum, stainless steel, galvanized steel, etc. and be of welded or stamped construction or otherwise connected by other conventional fasteners. It will be fisher appreciated, however, that the mounting member 110 could be molded or otherwise fabricated from a polymeric material or other non-corrosive material. As can be seen in FIG. 6, the top portion 10 has an upper locking protrusion 120 that has a hole 122 therethrough. Similarly, the bottom portion 116 has a lower protrusion 124 that has a bole 126 therethrough. Holes (122, 126) are coaxially aligned along a "first" pivot axis, generally designated as G—G. To facilitate attachment of the mounting member 110 to a variety of different support surfaces or members, a series of mounting holes 119 are provided through the rear portion 112. See FIG. 10. The mounting member 110 also includes side support members (130, 136).

Figure 11:
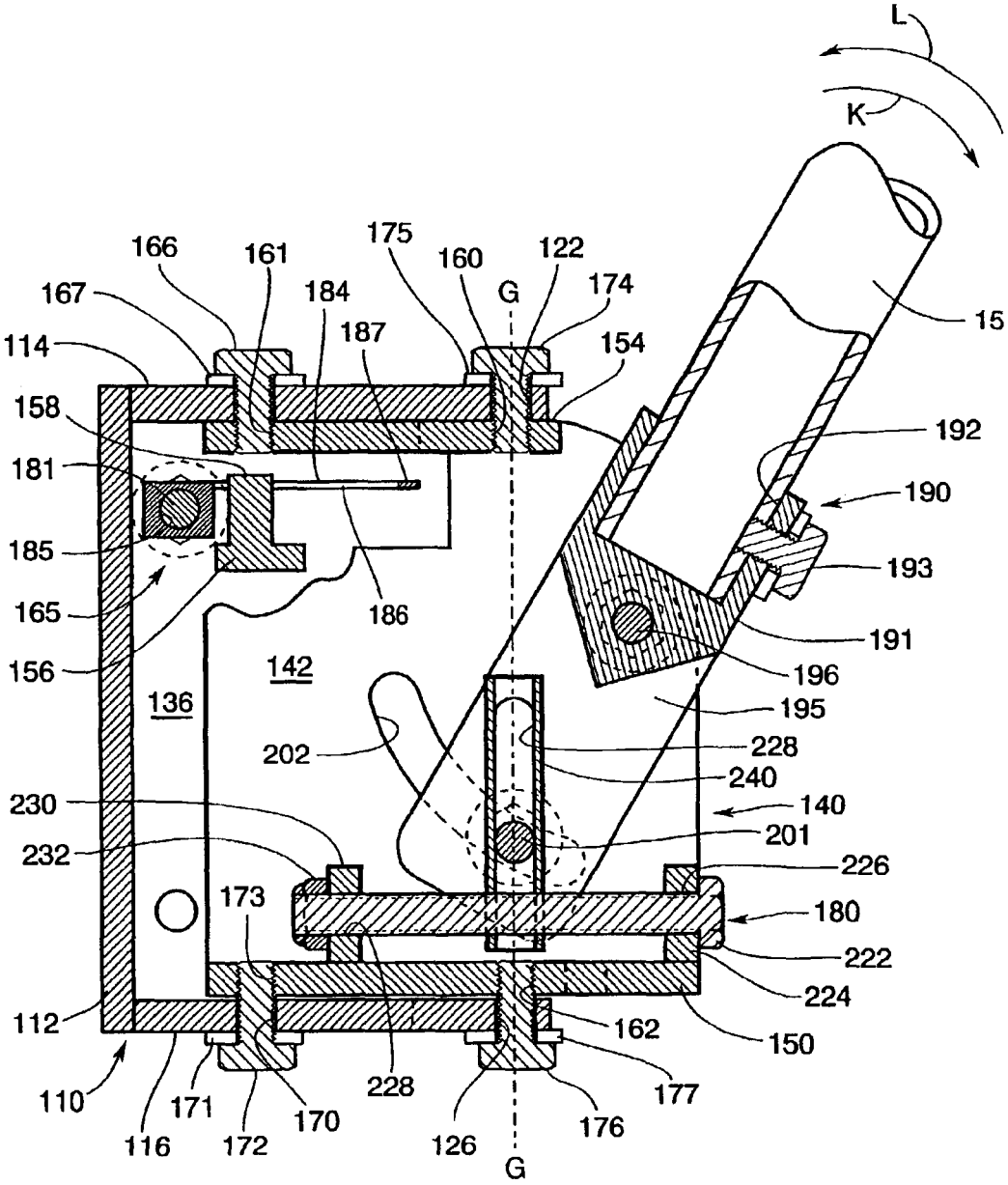
FIG. 11 is a cross-sectional view of the mounting bracket depicted in FIGS. 4–10 taken along line XI—XI in FIG. 9.

The mounting member 110 pivotally supports a support member 140. In one embodiment, the support member 140 includes a pair of side plates (142, 146), a bottom portion 150 and a top portion 154. The support member 140 may be fabricated from metal, such as aluminum, stainless steel, galvanized steel, etc. and be of welded or stamped construction or the various portions of the support member 140 may be interconnected utilizing other conventional fasteners. It will be further appreciated, however, that the support member 140 could be molded or otherwise fabricated from a polymeric material or other non-corrosive material. As can be seen in FIG. 11, a pair of threaded top pivot holes 160 and 161 extend through the top portion 154 and a threaded bottom pivot hole 162 extends through the bottom portion 150. When assembled as shown in FIG. 11, holes (160, 162) are coaxially aligned along the first pivot axis "G—G". The support member 140 is pivotally supported on the mounting member 110 by a "first locking member" which may comprise a top locking screw 174 extends through the upper hole 122 in the upper portion 114 of the mounting member 10 and is threadably received in an upper threaded hole 160 in the top portion 154 of the support member 140. A top washer 175 may be placed on screw 174. In addition, the support member 140 is further pivotally supported on the mounting member 110 by a "second locking member" which may comprise a bottom locking screw 176 extends through the bottom hole 126 in the bottom portion 116 of the mounting member 110 to be threadably received in a lower threaded hole 162 in the bottom portion 150 of the support member 140. A washer 177 may be placed on screw 176 as shown. As can also be seen in FIG. 9, in this embodiment another "first locking member" which may comprise a locking screw 166 extends through an arcuate top slot 168 in the top portion 114 of the mounting member 110 and is threadably received in threaded-hole 161 in the top portion 154 of the support member 140. A washer 167 may be placed on the screw 166. Also in this embodiment, another "second locking member" which may comprise a locking screw 172 extends through an arcuate bottom slot 170 through the bottom portion 116 of the mounting member 110 to be threadably received in a threaded hole 173 in the bottom portion 150 of the support member 140. A washer 171 may be placed on screw 172 as shown.

The arcuate top slot 168 is radially aligned about the center of hole 122 through which axis G—G extends. Similarly, the arcuate bottom slot 170 is radially aligned about the center of hole 126 through which the first pivot axis G—G extends. Slot 168 is sized to slidably receive a portion of the locking screw 166 therethrough. The center of arcuate slot 168 is oriented at a radius "R" with respect to the center of hole 122. The arcuate slot 170 is sized to slidably receive a portion of the locking screw 72 therein. The center of arcuate slot 170 is oriented at a radius "R'" that is equal to radius R. See FIG. 6. Those of ordinary skill in the art will appreciate that when the locking screws (166, 172, 174, 176) are loosened, the support member 140 can pivot about the first pivot axis G—G relative to the mounting member 110.

Figure 7:
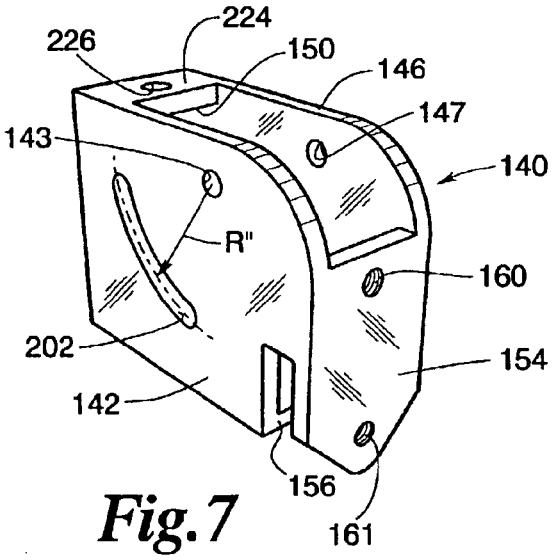
FIG. 7 is a perspective view of a support member of the mounting bracket depicted in FIGS. 4–6.
Figure 13:
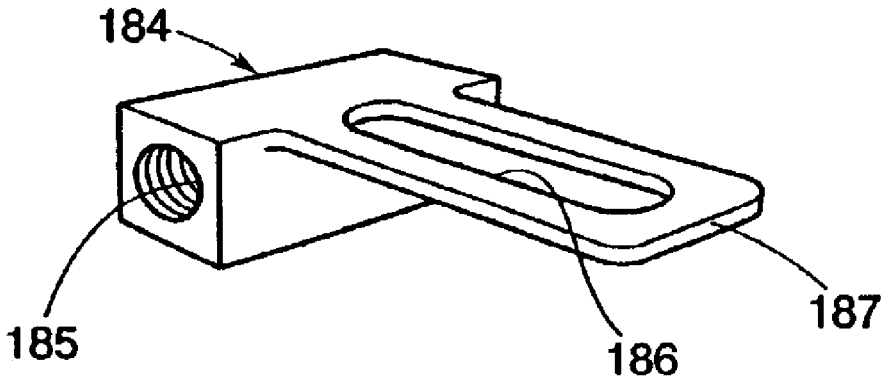
FIG. 13 is a perspective view of a pivot bar of the mounting bracket depicted in FIGS. 4–12.
Figure 14:
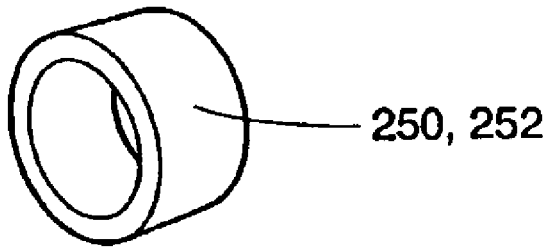
FIG. 14 is a perspective view of a spacer sleeve of the mounting bracket depicted in FIGS. 4–13.

Also in this embodiment, to control the pivotal travel of the support member 140 about the first pivot axis G—G and to positively retain the support member 140 in position while the locking screws (166, 172, 174, 176) are tightened, a "first adjustment assembly" or "first means for retaining", generally designated as 165, is provided. More specifically and with reference to FIGS. 7 and 11, the adjustment assembly or means for retaining of this embodiment includes a "pivot member" which may comprise a pivot pin 158 that protrudes from a support bar 156 that is formed in the support member 140. The first adjustment assembly or first means for retaining of this embodiment also includes a first "rotatable adjustment member" which may comprise a threaded adjustment bolt 181 that extends through a non-threaded hole 131 in side member 130. The first adjustment bolt 181 also extends through a non-threaded bole 137 in the side member 136. The first adjustment bolt 181 is threaded along its entire length and is rotatably retained in the holes (131, 137) by a lock nut 182 and washer 183. A pivot bar 184 is threadably received on the first adjustment bolt 181. The pivot bar 184 may be fabricated from a metal or plastic in the configuration shown in FIG. 13. One end of the pivot bar 184 has a pair of coaxially aligned threaded holes 185 for attaching the pivot bar 184 to the first threaded adjustment bolt 181. As can be further seen in FIG. 13, the pivot bar 184 has a tongue portion 187 that has an axially extending slot 186 for slidably receiving a portion of the pivot pin 158 therein.

In this embodiment, the skilled artisan will appreciate that, after the locking screws (166, 172, 174, 176) have been loosened, the support member 140 may be selectively pivoted about the first pivot axis G—G in the directions represented by arrows "H" and "I" by rotating the first adjustment bolt 181 in the appropriate directions. See FIG. 9. After the support member 140 has been pivoted to a desired position about the first pivot axis G—G, it may be "locked" in position by tightening screws (166, 172, 174, 176).

Figure 8:
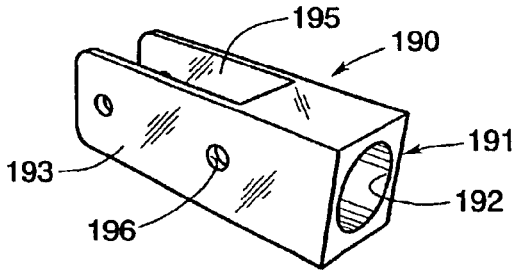
FIG. 8 is a perspective view of a mast support member of the mounting bracket depicted in FIGS. 4–7.

This embodiment of the mounting bracket 100 of the present invention further comprises an object support member or mast support member 190 that is pivotally supported by the support member 140. While the mast support member 190 as described herein is particularly suited for supporting an antenna mast therein, those of ordinary skill in the art will appreciate that the mast support member may be constructed to support a variety of other objects without departing from the spirit and scope of the present invention. It will be further appreciated that for applications wherein pivotal travel of the object about a single axis (i.e., axis G—G) is required, the mast support member 190 may be rigidly attached to the support member 140 or comprise an integral portion of the support member 140. As can be seen in FIGS. 8 and 11, in this embodiment, the mast support member 190 has a mast-supporting end 191 that has a socket 192 therein sized to receive a portion of an antenna support member which may comprise an antenna mast 15 therein. A pair of spaced-apart mounting plates (193, 195) protrude from the mast-supporting end 191. The mast-supporting end 191 has a hole 196 extending therethrough that is adapted to be coaxially aligned with hole 143 in the side plate 142 and hole 147 in the side plate of the support member 140 along a second pivot axis J—J. The second pivot axis J—J may be perpendicular to the first pivot axis G—G. The mast support member 190 is pivotally attached to the support member 140 by a pivot bolt 197 that extends through the holes (143, 196, 147) and is retained therein by a nut 198 and washer 199. Thus, when the nut 198 is loosened, the mast support member 190 is free to pivot about the second pivot axis J—J relative to the support member 140.

Figure 9:
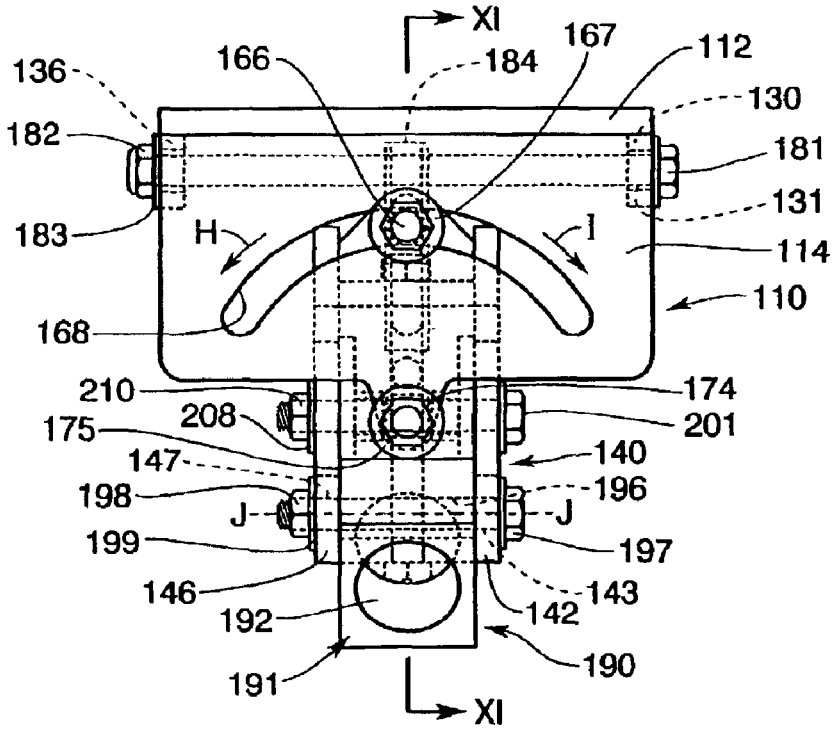
FIG. 9 is a top assembly view of the mounting bracket depicted in FIGS. 4–8.
Figure 10:
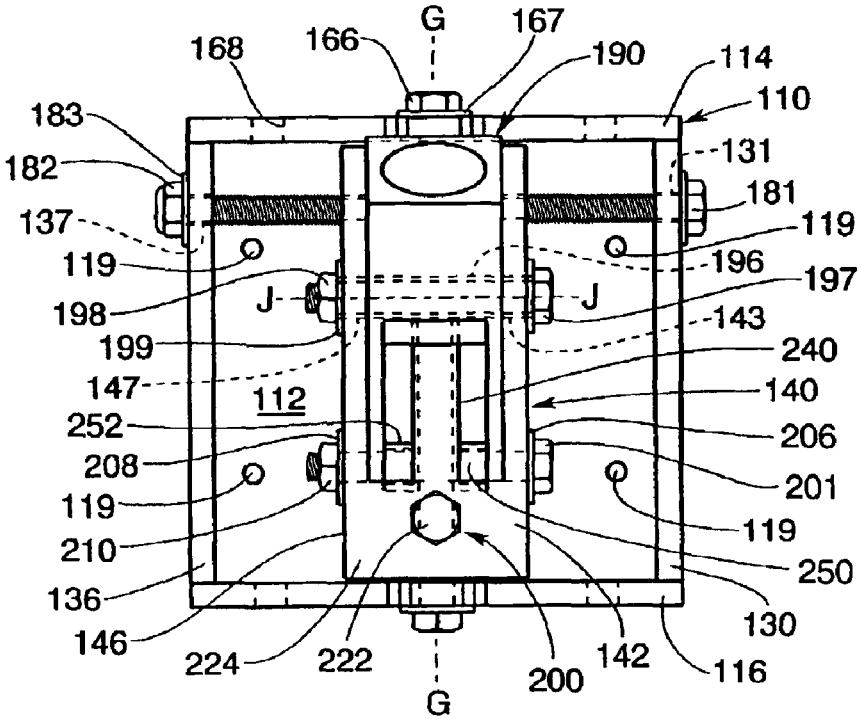
FIG. 10 is a front assembly view of the mounting bracket depicted in FIGS. 4–9.
Figure 12:
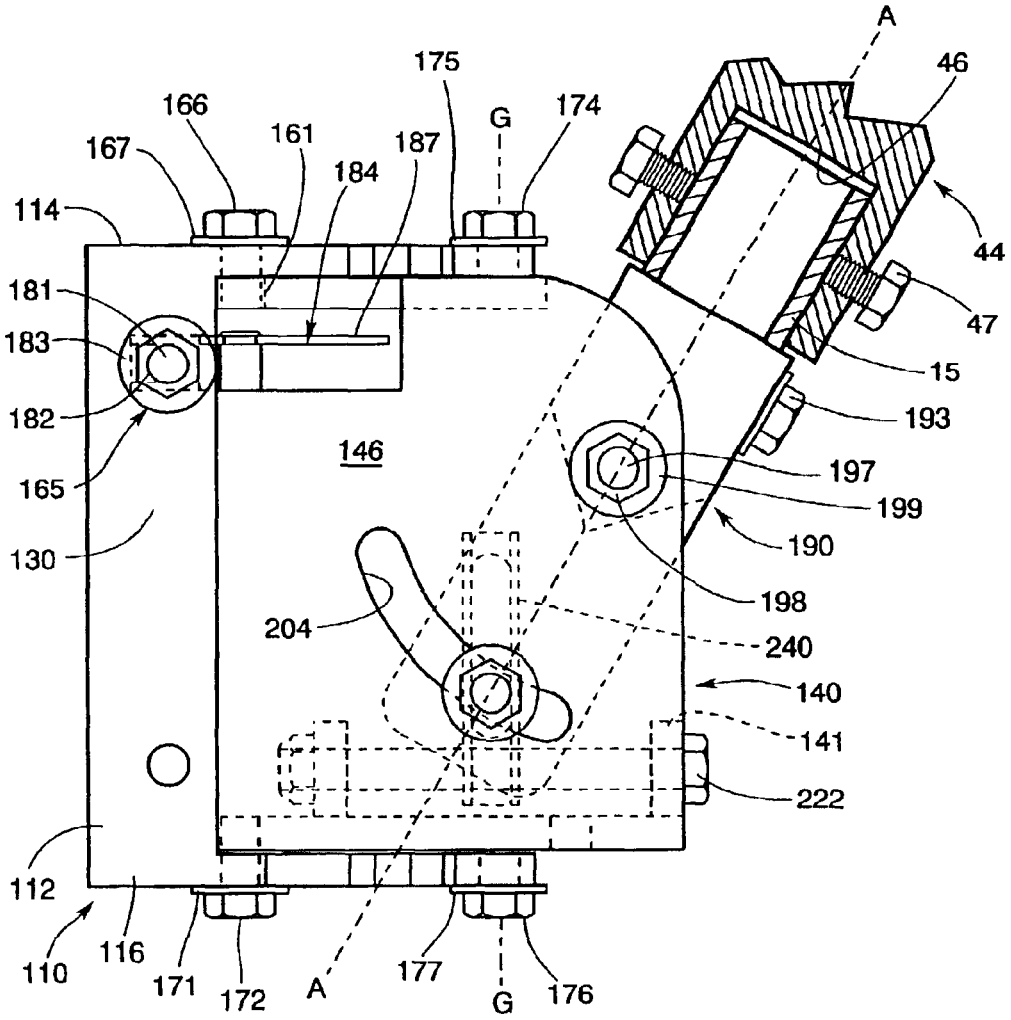
FIG. 12 is a side elevational view of the mounting bracket depicted in FIGS. 4–11 supporting an antenna mast that is attached to a support arm of an antenna.

Also in this embodiment, to control the pivotal travel of the mast support member 190 about the second pivot axis J—J and to positively retain the mast support member 190 in position about the second pivot axis J—J while the lock nuts (198, 210) are tightened, a second adjustment assembly or "second means for retaining", generally designated as 200 is provided. In this embodiment, the second adjustment assembly or second means for retaining 200 includes a second shoulder bolt 201. More particularly and with reference to FIGS. 7 and 11, a primary arcuate slot 202 is provided in the side plate 142 of the support member 140. Primary arcuate slot 202 is radially aligned about the center of hole 143 through which the second pivot axis J—J extends. The primary arcuate slot 202 is sized to slidably receive a portion of the second shoulder bolt 201 therethrough. The center of the primary arcuate slot 202 is oriented at a radius "R"" with respect to the center of the hole 143. See FIG. 7. Similarly, a secondary slot 204 is provided through the side plate 146 of the support member 140. See FIG. 12. Secondary arcuate slot 204 is radially aligned about the center of hole 147 through which the second pivot axis J—J extends. The secondary arcuate slot 204 is sized to slidably receive therethrough another portion of the second shoulder bolt 201. The center of the secondary slot 204 is aligned at a radius with respect to the center of hole 147 that is equal to radius R". As can be seen in FIGS. 9 and 10, washers (206, 208) are received on the second shoulder bolt 201 and a second lock nut 210 is threaded onto the threaded end thereof.

The second adjustment assembly or second means for retaining 200 of this embodiment also includes a "second rotatable adjustment member" which may comprise a second threaded adjustment bolt 222 that extends through a non-threaded hole 226 in a front plate member 224 that comprises a portion of the support member 140. Adjustment bolt 222 further extends through a non-threaded hole 228 in a rear plate 230 that comprises a portion of the support member 140. Adjustment bolt 222 is rotatably supported on the front plate 224 and the rear plate 230 by a lock nut 232. See FIG. 11. A second pivot bar 240 is movably attached by means of threads to the second adjustment bolt 222. The second pivot bar 240 may be fabricated from a piece of hollow metal tubing or other suitable material. As can be seen in FIG. 5, one end of the second pivot bar 240 has a pair of coaxially aligned threaded holes 242 for attaching the second pivot bar 240 to the second adjustment bolt 222. As can be further seen in FIG. 5, the second pivot bar 240 has an axially extending slot 244 for slidably receiving a portion of the second shoulder bolt 201 therein. A pair of spacer sleeves (250, 252) are slidably received on the second shoulder bolt 201 with one spacer sleeve being oriented on each side of the second pivot bar 240 to prevent binding of the second pivot bar 240 on the second shoulder bolt 201. See FIGS. 10 and 15. The skilled artisan will appreciate that the spacer sleeves (250, 252) and the pivot bar 240 could comprise a unitary member if so desired. It will be further appreciated that after the nuts (198, 210) have been loosened, the mast support member 190 may be selectively pivoted about the second pivot axis J—J in the directions represented by arrows "K" and "L" by rotating the second adjustment bolt 200 in the appropriate directions. See FIG. 11. After the mast support member 190 has been pivoted to a desired position, it is then "locked" in position by tightening the lock nuts (198, 210).

Figure 15:
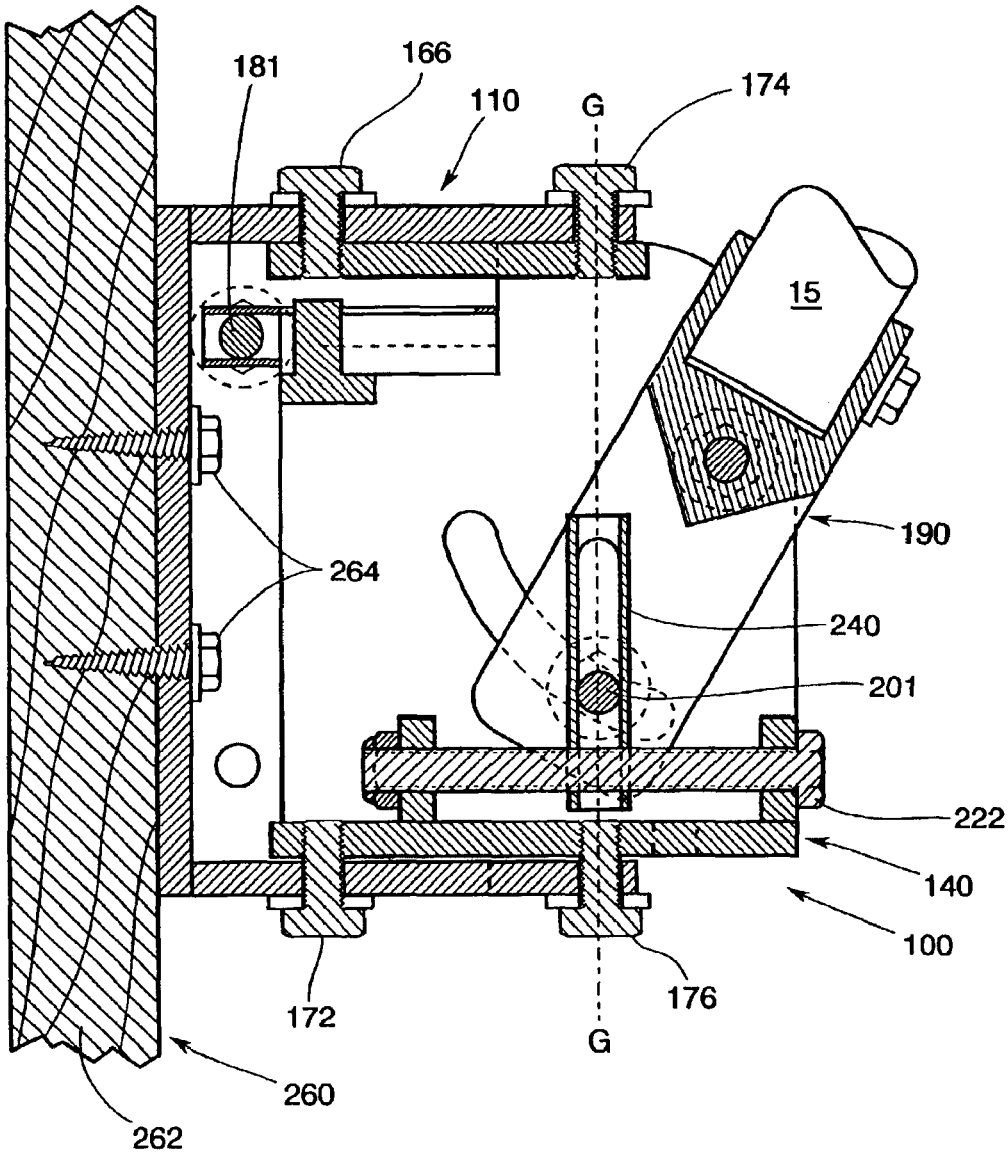
FIG. 15 is a cross-sectional view of the mounting bracket depicted in FIGS. 4–14 attached to a vertical wall of a structure.
Figure 16:
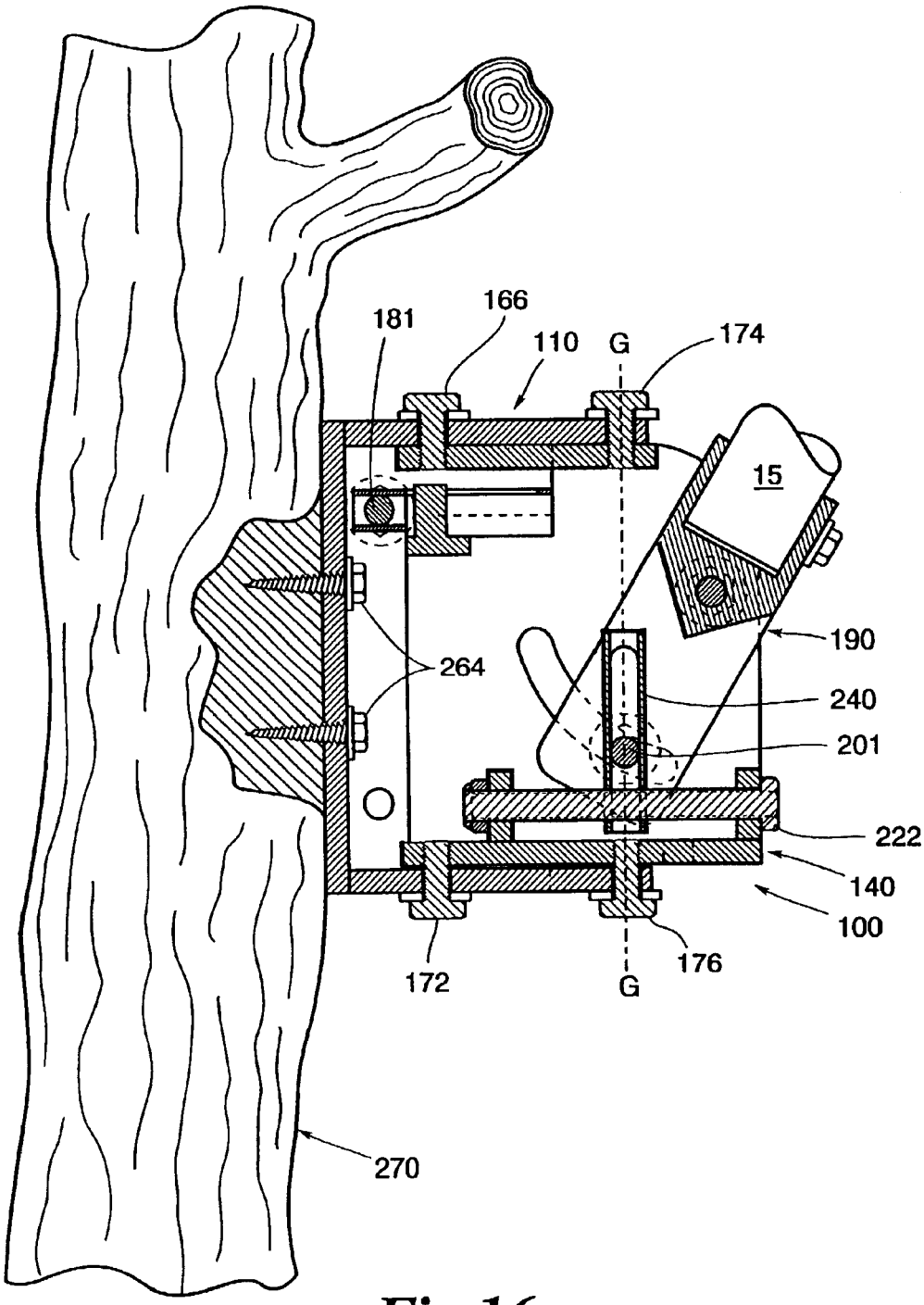
FIG. 16 is a cross-sectional view of a mounting bracket attached to a tree.
Figure 17:
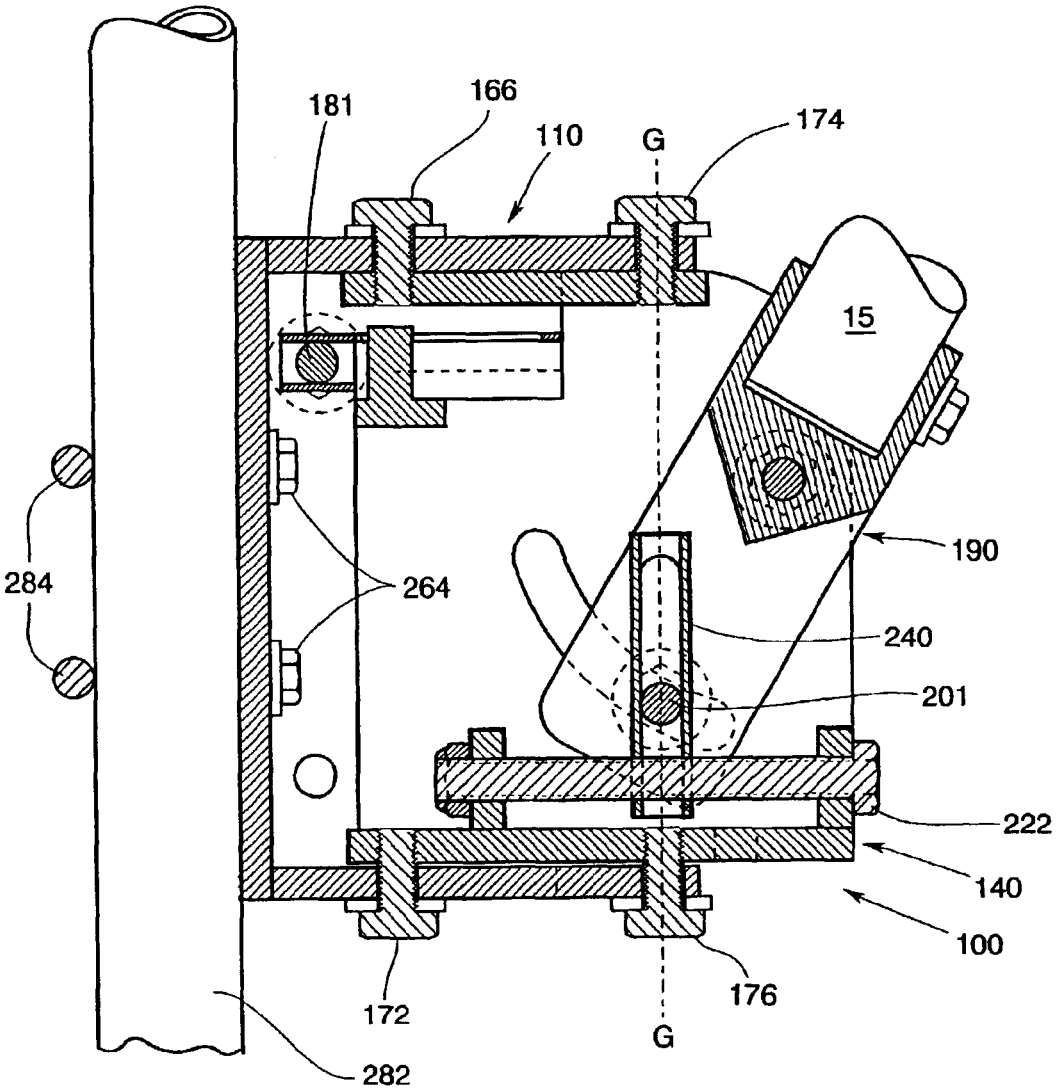
FIG. 17 is a cross-sectional view of a mounting bracket attached to a vertically extending pole or mast.
Figure 18:
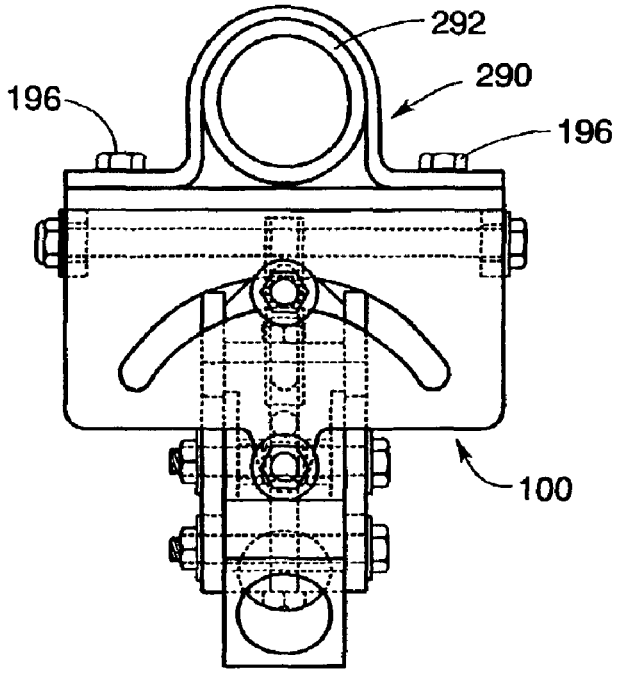
FIG. 18 is a top view of a conventional saddle bracket used to attach a mounting bracket of the present invention to a mast.
Figure 19:
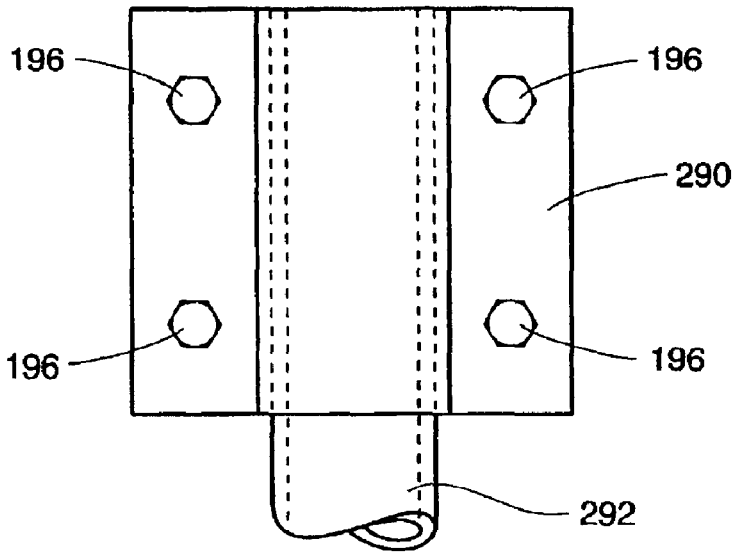
FIG. 19 is a rear view of the mounting bracket and saddle bracket depicted in FIG. 18.
Figure 20:
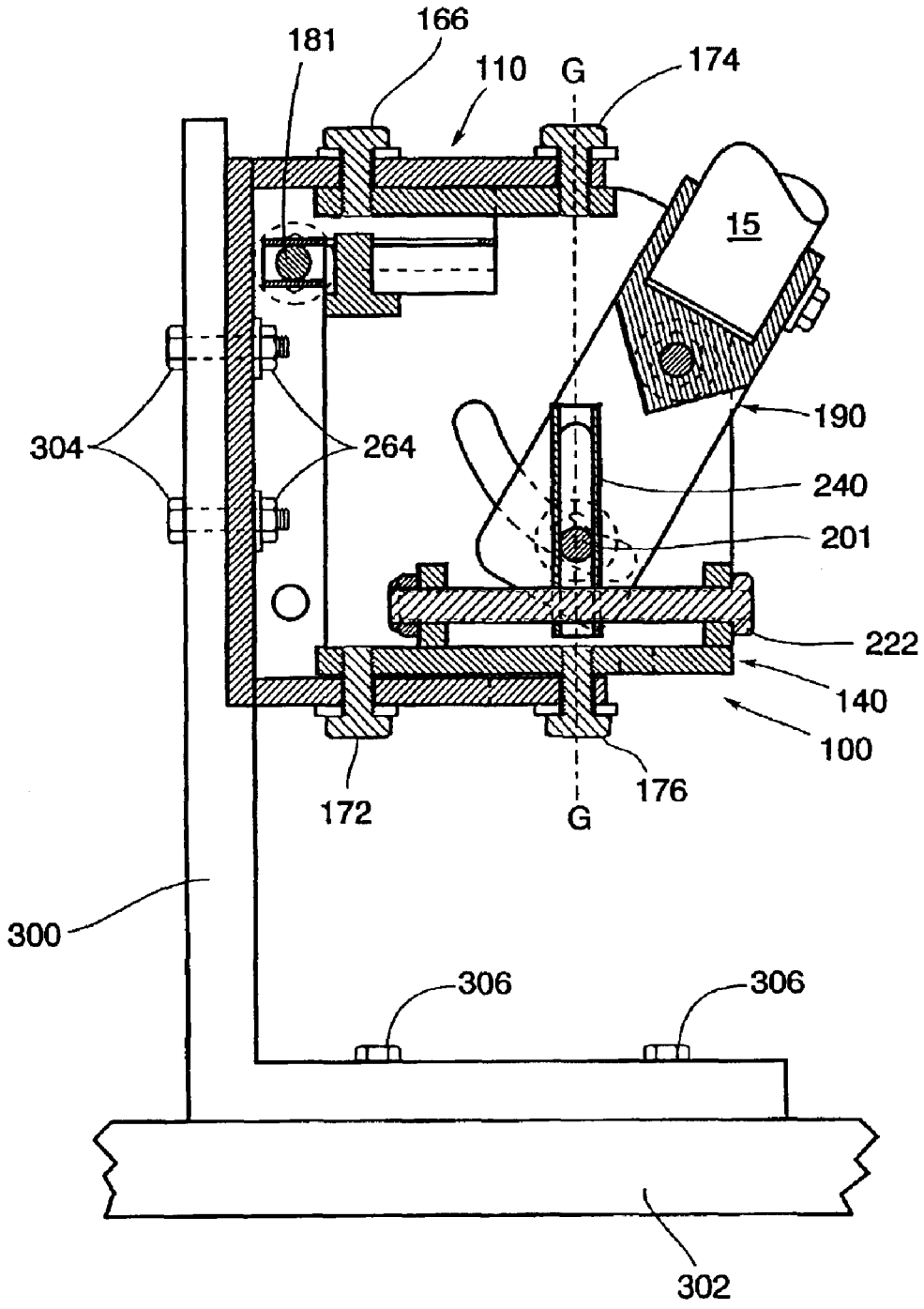
FIG. 20 is a partial cross-sectional view of a mounting bracket attached to a horizontal support surface with an L-bracket.

To use this embodiment of the mounting bracket 100 of the present invention, the mounting member 110 is attached to a support member such as a wall, tree, support mast, etc. For example, as illustrated in FIG. 15, the mounting member 110 may be attached to a vertically extending portion 262 of a building 260 or other structure by mounting screws 264. As shown in FIG. 16, the mounting member 10 may be attached to a portion of tree 270 by appropriate screws 272. FIG. 17 illustrates the use of conventional clamps 284 to clamp the mounting member to a mast 282, a portion of which is either attached to another structure or is buried in the earth such that it is plumb. FIGS. 18 and 19 illustrate the use of a conventional saddle clamp 290 to clamp the mounting member to a mast 292, a portion of which is either attached to another structure or is buried in the earth such that it is plumb. As can be seen in those Figures, the saddle clamp 290 is attached to the mounting 110 by four bolts 196 or other suitable fasteners. FIG. 20 illustrates the attachment of the mounting member 110 to an L-shaped bracket 300 that is attached to a horizontal support member 302 such as a portion of a deck or the like. The L-shaped bracket is attached to the mounting member by bolts 304 or other suitable fasteners. The other portion of the L-shaped bracket 300 is attached to the support surface 302 by wood screws 306 or other suitable fasteners.

Figure 8A:
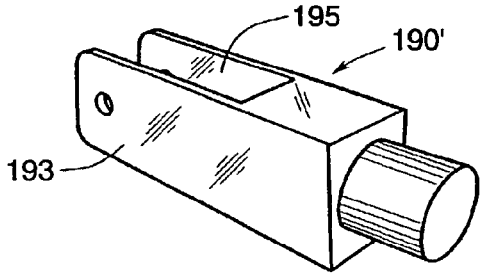
FIG. 8A is a perspective view of another mast support embodiment of the mounting bracket employed in one embodiment of the present invention.
Figure 12A:
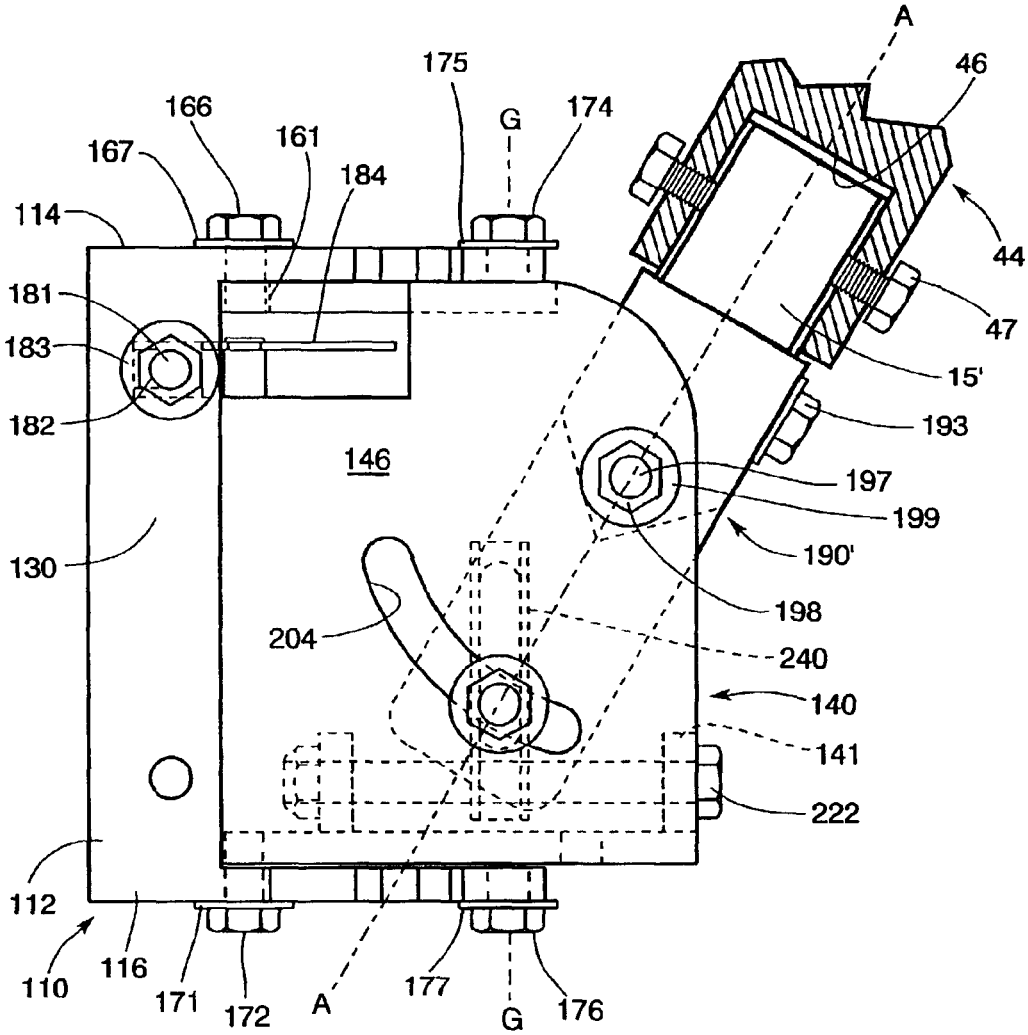
FIG. 12A is a side elevational view of another mounting bracket embodiment employing the mast support member depicted in FIG. 8A.

After the mounting member 110 has been mounted to a support structure, the antenna mast 15 is inserted into the mast-receiving socket 192 in the mast support member 190. Antenna mast 15 may be retained in the socket 192 by one or more retaining screws 193 that are threaded into engagement with the antenna mast 15. See FIG. 11. However, other fasteners and attachment methods may be employed for affixing the antenna mast 15 to the antenna mast support member 190. In this embodiment, the antenna 20 is connected to the mounting mast 15 by a rearwardly extending portion 44 of the support arm 40. A socket 46 is provided in the rearwardly extending portion 44 for receiving the other end of the antenna mast 15 therein. The mast is retained in the socket 46 by locking screws 47. See FIGS. 3 and 12. Those of ordinary skill in the art will readily appreciate, however, that other antenna arrangements and designs may be successfully used in connection with the mounting bracket 100 of the present invention. For example, an alternate embodiment of the mast support member 190 is depicted in FIGS. 8A and 12A. As can be seen in those Figures, the mast support member 190' is identical to mast support member 190 described above, except that the mast support member 190' has an integral mast 15' protruding therefrom which can be inserted into the socket 46 of a support arm 40 and retained therein by locking screws 47.

Figure 3:
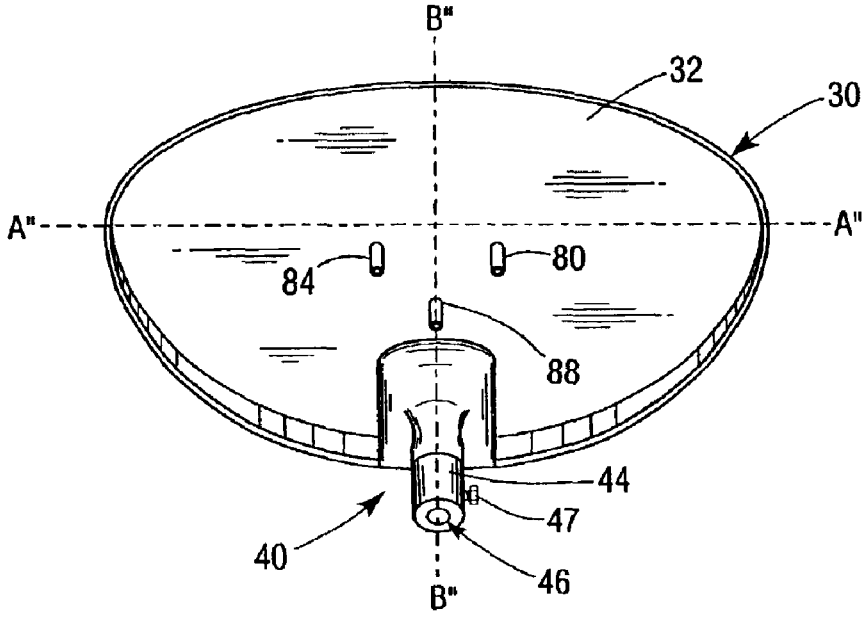
FIG. 3 is a rear view of the antenna depicted in FIG. 2.

In the antenna design depicted in FIGS. 1–3, the antenna's centerline axis A—A is coaxially aligned with the center of the antenna mounting mast 15 and the mast-receiving socket 192 in the mast-support member 190. Thus, such arrangement permits the antenna 20 to be readily adjusted for satellite skew by loosening the retaining screws 193 and rotating the mounting mast (and antenna 20 attached thereto) within the mast-receiving socket 192 until the desired skew orientation is achieved. Thereafter, the retaining screws 193 are screwed into engage the antenna mast 15 and retain it in that position. When employing the embodiment depicted in FIG. 12A, the antenna 20 may also be oriented in a desired skew orientation by loosening the locking screws 47 in the rearwardly extending portion 44 of the support arm 40 and rotating the rearwardly extending portion 44 about mast protrusion 15' therein until the antenna 20 is in a desired orientation. Thereafter, the locking screws 47 are screwed into engage the mast protrusion 15' to retain the antenna 20 in that position. Such arrangement enables the antenna 20 to be easily adjusted for satellite skew without altering the antenna's azimuth and/or elevation orientations.

After the antenna has been attached to the mounting bracket 100, the antenna's azimuth may be easily adjusted by loosening the lock screws (166, 172, 174, 176). Thereafter, the first adjustment bolt 181 is rotated in the appropriate direction to cause the support member 140 to pivot in a desired direction about the first pivot axis G—G. Such rotation of the adjustment bolt causes the pivoting of the support member 140 about the first pivot axis G—G in a controlled manner. Those of ordinary skill in the art will appreciate that the first adjustment assembly, by virtue of the threaded engagement of the first pivot bar 184 with the first adjustment bolt 181, serves to positively retain the support member in the desired position while the lock screws (166, 172, 174, 176) are tightened to rigidly retain the support member 140 in that position. Thus, this aspect of the present invention represents a vast improvement over prior antenna mounting brackets that lack means for positively retaining support member in a desired azimuth position, while the locking members are tightened.

To adjust the antenna's elevation, the lock nut 198 and the lock nut 210 are loosened. Thereafter, the second adjustment bolt 222 is rotated in the appropriate direction to cause the mast support member 190 to pivot in the desired direction about the second pivot axis J—J in a controlled manner. Those of ordinary skill in the art will appreciate that the second adjustment assembly, by virtue of the threaded engagement of the second pivot bar 240 with the second adjustment bolt 222, serves to positively retain the mast support member 190 in the desired position while the lock nuts (198, 210) are tightened to rigidly retain the mast support member 190 in that position. Thus, this aspect of the present invention represents a vast improvement over prior antenna mounting brackets that lack means for positively retaining the mast-supporting member in a desired elevational position, while the locking members are tightened.

Figure 21:
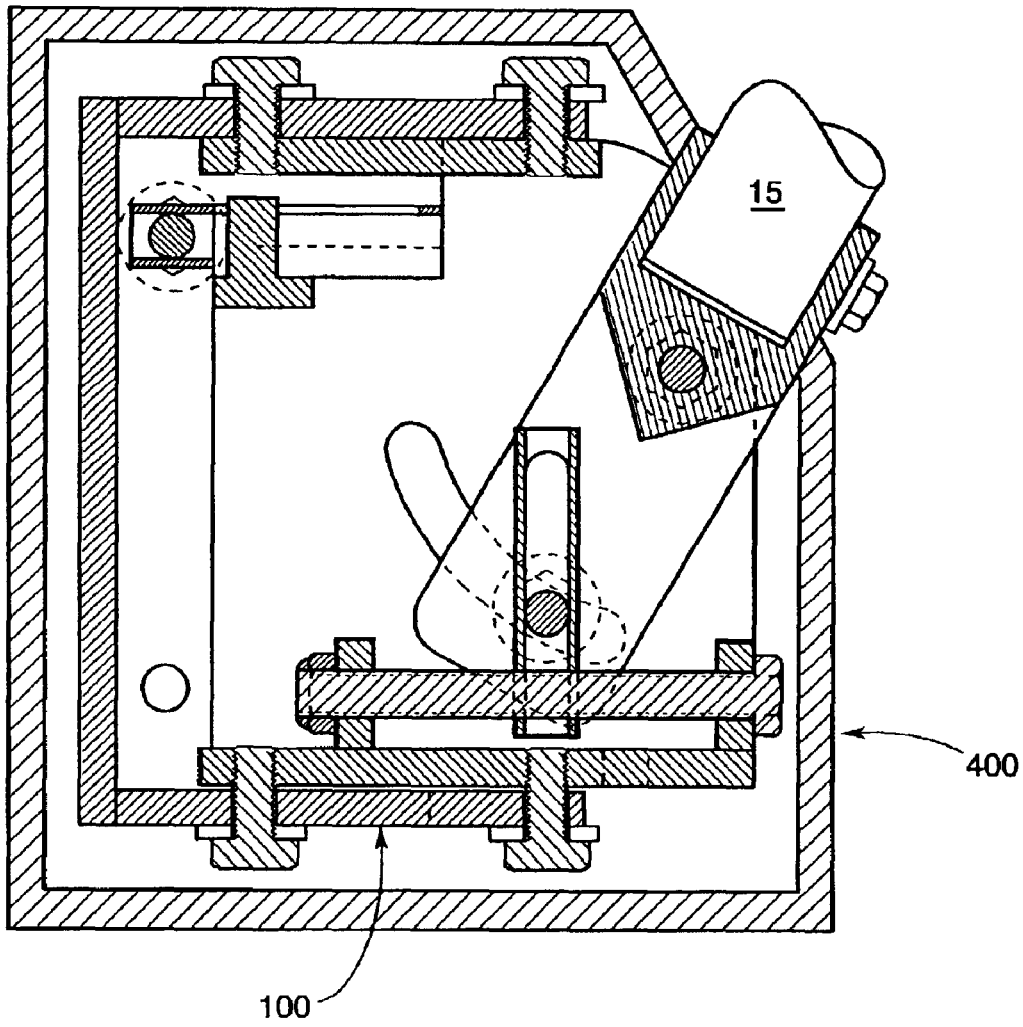
FIG. 21 is a cross-sectional view of a mounting bracket and removable shroud shown in cross-section.

The above-described mounting bracket embodiment is particularly useful for mounting and orienting an antenna along a plurality of axes. Those of ordinary skill in the art will appreciate that the mast support member 190 described above could be provided in a variety of other configurations that are adapted to attach various other objects to the mounting bracket. Those of ordinary skill in the art will further appreciate that for applications that require the mounting bracket to be exposed to the elements, the various fasteners employed in the mounting bracket may be fabricated from corrosion resistant material such as stainless steel or the like. Furthermore, the fasteners employed in the mounting bracket 100 may comprise the same size of screw or bolt (not necessarily the same length) such that a single wrench may be employed by the installer to mount the bracket and make all of the adjustments thereto. Also, if desired, to protect the mounting bracket 100 from the elements and establish a more aesthetically pleasing appearance, a shroud 400 made from a suitable material may be placed around the bracket. See FIG. 21. Shroud 400 may be fabricated from flexible plastic or rigid plastic and may be one or more parts that are fastened together around the mounting bracket 100 by appropriate fasteners, such as screws, etc.

Figure 3A:
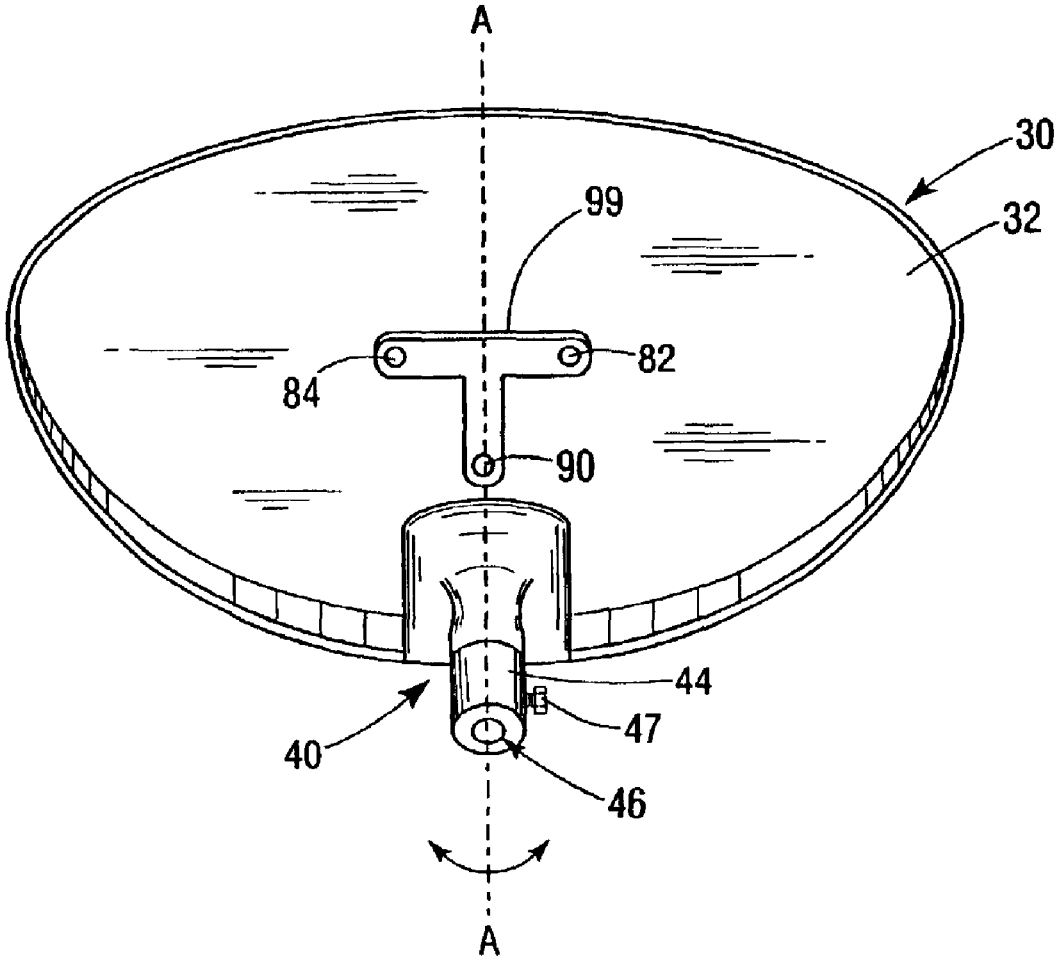
FIG. 3A is a rear view of another antenna that may be employed with the present invention.
Figure 22:
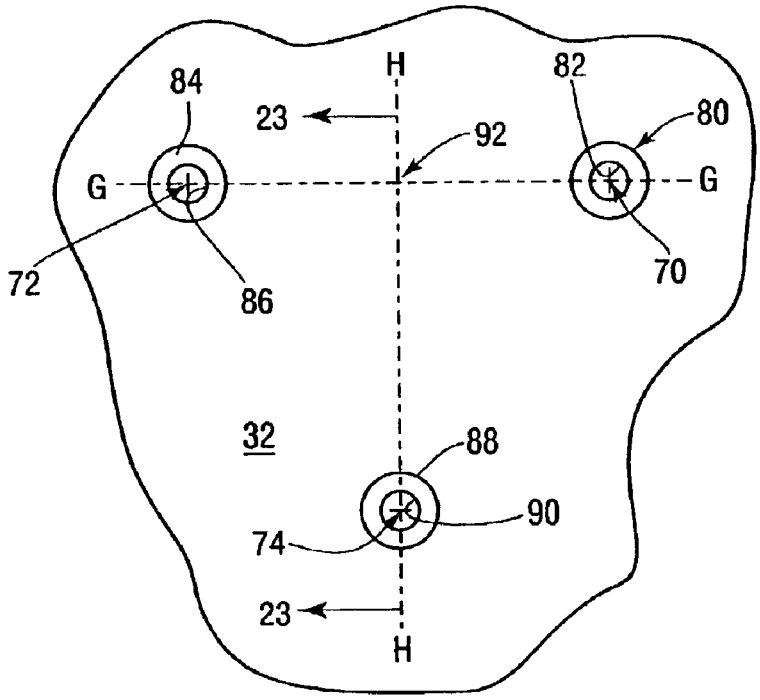
FIG. 22 is a partial view of the rear surface of the antenna depicted in FIGS. 2 and 3 illustrating three points that define a plane that is perpendicular to the centerline axis of the antenna.
Figure 23:
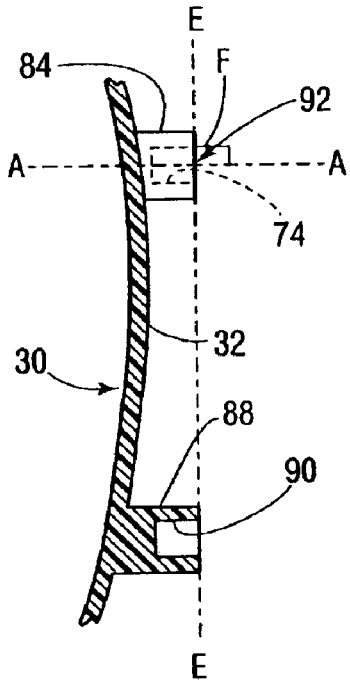
FIG. 23 is a partial cross-sectional view of the antenna of FIG. 22 taken along line 23—23 in FIG. 22.
Figure 22A:
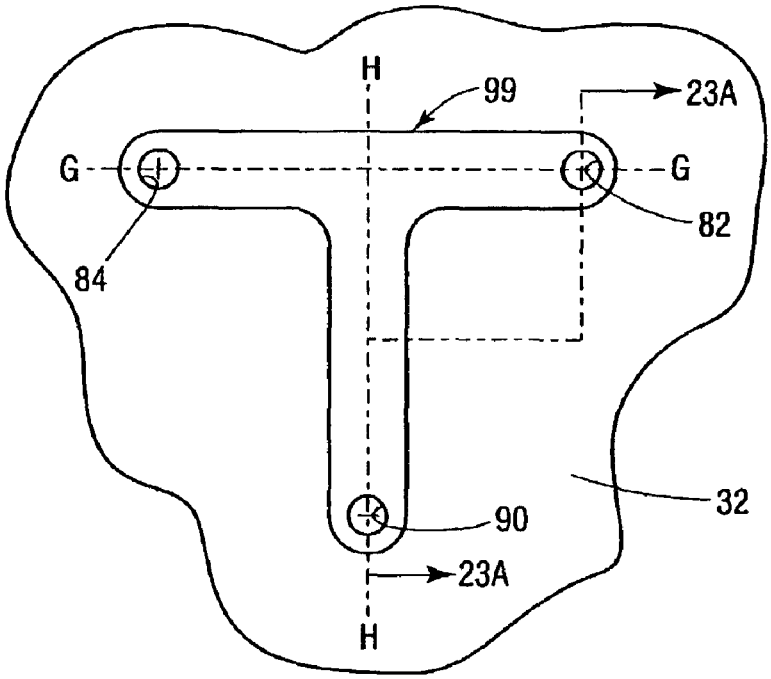
FIG. 22A is a partial view of a rear surface of another antenna with which the alignment devices of the present invention may be employed.
Figure 23A:
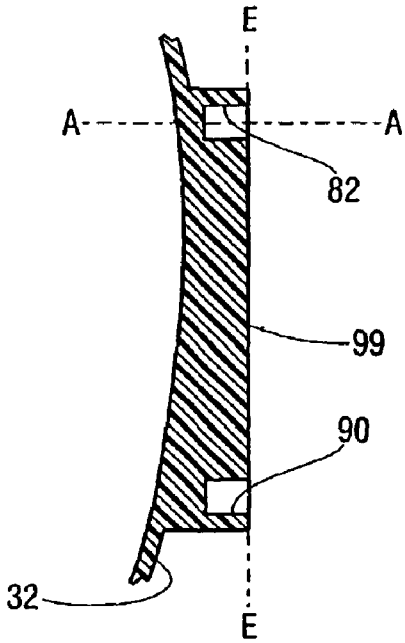
FIG. 23A is a partial cross-sectional view of the antenna of FIG. 22A taken along line 23A—23A in FIG. 22A.
Figure 22B:
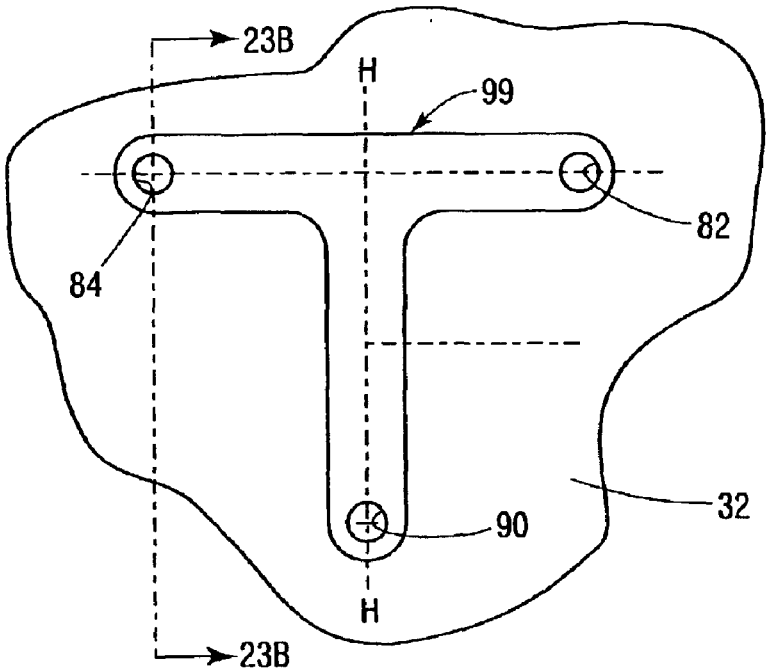
FIG. 22B is a partial view of a rear surface of another antenna with which the alignment devices of the present invention may be employed.
Figure 23B:
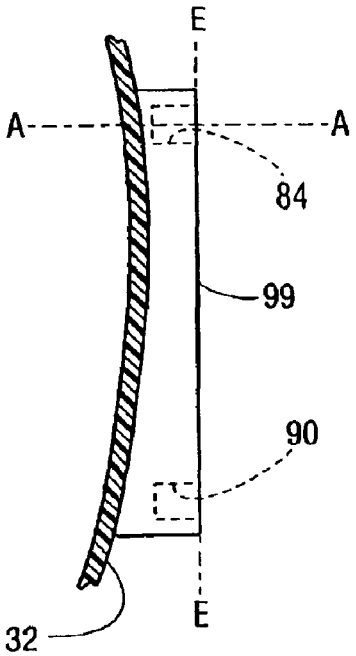
FIG. 23B is a partial cross-sectional view of the antenna of FIG. 22B taken along line 23B—23B in FIG. 22B.

In this embodiment, the reflector 30 is molded from plastic utilizing conventional molding techniques. However, reflector 30 may be fabricated from a variety of other suitable materials such as, for example, stamped metal such as aluminum, steel, etc. The reflector 30 depicted in FIGS. 2 and 3 has a rear portion or surface 32 and a front surface 34. The support arm assembly is affixed to the lower perimeter of the reflector 30 by appropriate fasteners such as screws or like (not shown). As can be seen in FIGS. 22 and 23, the rear surface 32 is provided with three points (70, 72, 74) that define a plane, represented by line E—E, that is perpendicular or substantially perpendicular to the centerline axis A—A of the reflector (i.e., angle "F" is approximately 90 degrees). In this particular embodiment, point 70 is defined by a first socket 80 that is integrally molded or otherwise attached to the rear surface 32 of the reflector 30. Point 72 is defined by a second socket 84 that is integrally molded or otherwise attached to the rear surface 32 of the reflector 30. Similarly, point 74 is defined by a third socket 88 that is integrally molded or otherwise attached to the fear surface 32 of the reflector 30. Those of ordinary skill in the art will appreciate, however, that the points (70, 72, 74) may be defined by other members that are attached to the rear surface 32 of the reflector 30 by other fastener mediums such as adhesive or the like. In this embodiment, the first socket 80 has a first hole 82 therein, the second socket 84 has a second hole 86 therein and the third socket 88 has a third hole 90 therein. In an alternative embodiment as shown in FIGS. 3A, 22A, and 23A, the holes (82, 84, 90) are formed in a planar attachment portion 99 that is integrally formed with the rear surface 32 of the reflector 30. The planar attachment portion 99 serves to define the plane E—E that is substantially perpendicular to the centerline axis A—A of the reflector 30. In yet another alternative embodiment depicted in FIGS. 22B and 23B, the attachment portion 99 is attached to the rear surface 32 of the reflector 30 by a fastener medium such as adhesive, screws, etc. The purpose of the holes (82, 84, 90) will be discussed in further detail below.

Turning now to FIGS. 24–28, one embodiment of the antenna pointing apparatus 300 of the present invention includes a mounting base 310 and an instrument housing 330 that protrudes from the mounting base 310. The mounting base 310 may be fabricated from plastic or other suitable materials. Although the mounting base 310 is depicted in FIGS. 24–28 as having a relatively rectangular shape, those of ordinary skill in the art will appreciate that the mounting base 110 may be provided with other suitable shapes without departing from the spirit and scope of the present invention. Housing 330 may be fabricated from plastic or other suitable materials and may have one or more removable panels or portions to permit access to the components housed therein. In one embodiment, housing 330 supports a conventional digital compass 340 that has a digital display 342. Digital compasses are known in the art and, therefore, the manufacture and operation thereof will not be discussed in great detail herein. For example, a digital compass of the type used in conventional surveying apparatuses, including that apparatus manufactured by Bosch could be successfully employed. As will be discussed in further detail below, when the antenna pointing apparatus 300 is affixed to the antenna reflector 30, the digital compass 340 will display on its display 342 the azimuth setting for the centerline axis A—A of the reflector 30. Thus, the digital compass 340 and its digital display 342 form an azimuth meter for determining the azimuth of the reflector 30 when it is attached to the rear surface 32 of the reflector 30.

Figure 27:
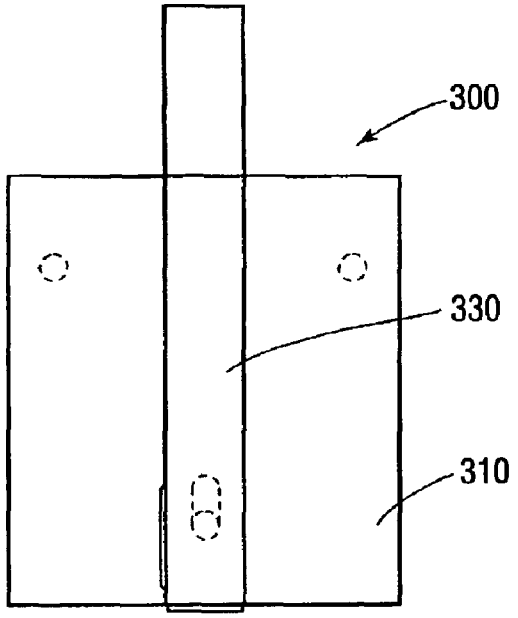
FIG. 27 is a top view of the antenna pointing apparatus of FIGS. 24–26.
Figure 28:
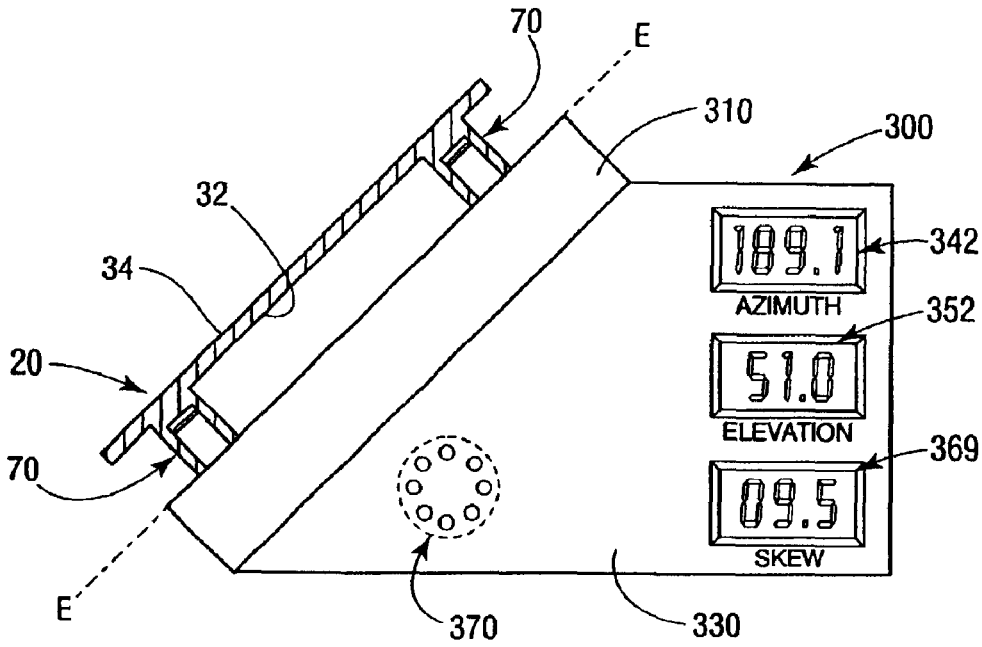
FIG. 28 is a side elevational view of the antenna pointing apparatus of FIGS. 24–26 attached to the rear surface of an antenna reflector with a portion of the antenna reflector shown in cross-section.

Also in this embodiment, a first digital level 350 which has a first digital display 352 is supported in the housing member 330 as shown in FIGS. 27 and 28. Such digital levels are known in the art and, therefore, their construction and operation will not be discussed in great detail herein. For example, a digital level of the type used in conventional surveying apparatuses, including those manufactured by Bosch may be successfully employed. However, other digital levels may be used. Referring back to FIG. 3, the reflector 30 has a major axis A"—A" that extends along the longest dimension of the reflector 30. Major axis A"—A" is perpendicular to the centerline A—A. Similarly, the reflector 30 has a minor axis B"—B" that is perpendicular to major axis A"—A" and is also perpendicular to the centerline A—A. In this embodiment, the centerline of the first digital level 350 is oriented such that it is received in a plane defined by the centerline axis A—A and the minor axis B"—B" when the device 300 is attached to the rear of the reflector 30.

Figure 27A:
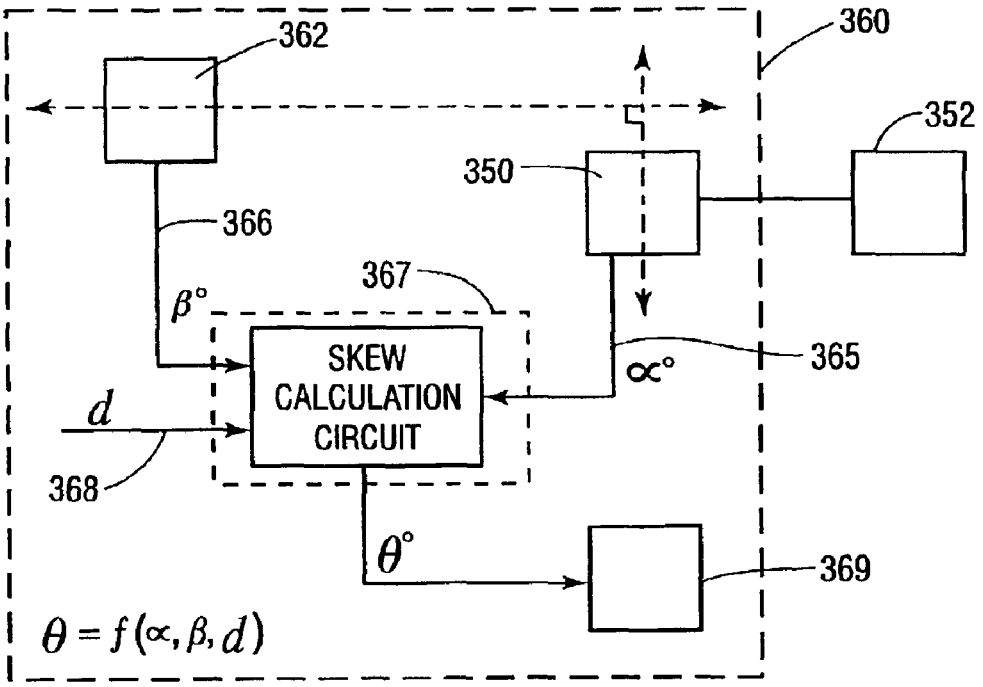
FIG. 27A is a schematic drawing of one control circuit arrangement that may be employed by one or more embodiments of the present invention to calculate the skew of the antenna to which it is attached.

This embodiment of the antenna-pointing device 300 also includes a skew meter 360. The skew meter 360 includes a second digital level 362 of the type described above that is mounted perpendicular to the first digital level 352 (i.e., its centerline will be within the plane defined by the centerline axis A—A and the reflector's major axis A"—A" when the device 300 is attached to the reflector 30). See FIG. 27A. The output of the first digital level 350, which is designated as 365 (defining angle α) and the output of the second digital level 362, which is designated as 366 (defining angle β), are sent to a conventional microprocessor 367. A calibration input, generally designated as 368 and defining distance "d" between a reference point on the device 300 and the centerline A—A of the reflector 30 is also sent to the microprocessor 367. Those of ordinary skill in the art will appreciate that the calibration input permits the installer to calibrate the device 300 for each individual reflector 30. Utilizing standard trigonometry calculations, the microprocessor 367 calculates the skew angle θ of the reflector 30 and displays it on a digital skew meter display 369.

Figure 24:
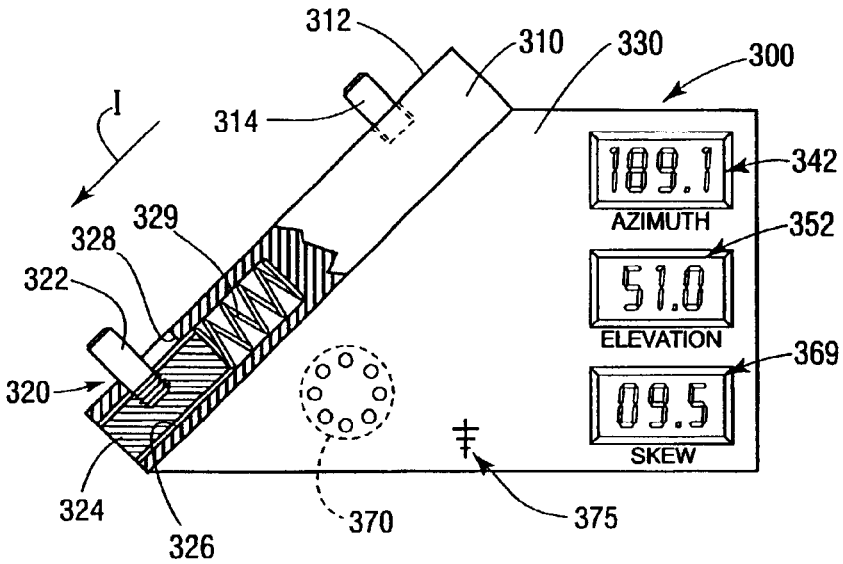
FIG. 24 is a side elevational view of an antenna pointing apparatus showing a portion of the mounting member in cross-section.
Figure 25:
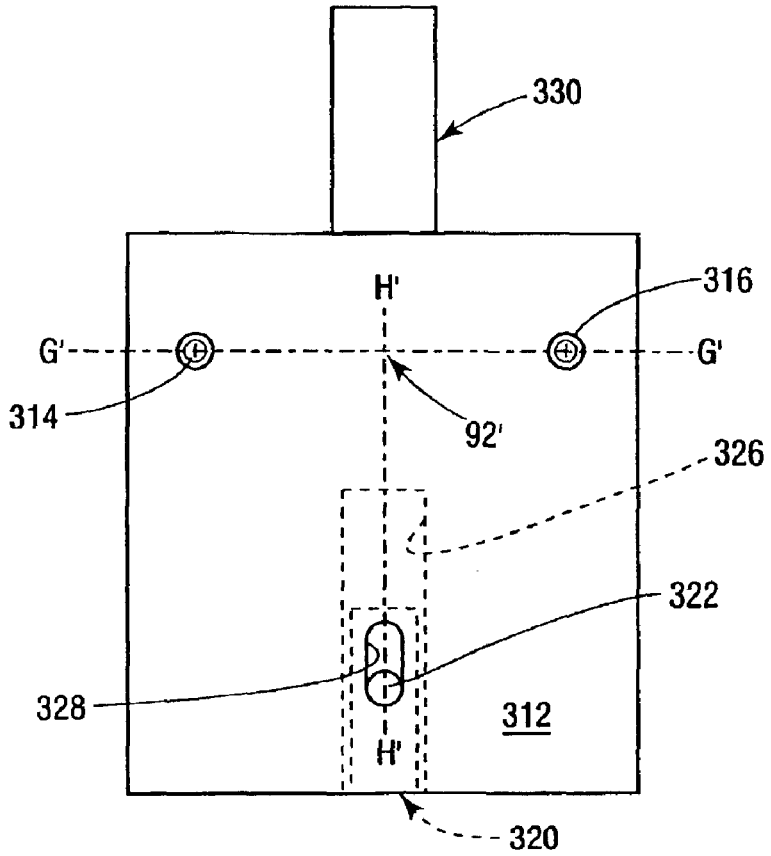
FIG. 25 is a bottom view of the antenna pointing apparatus of FIG. 24.
Figure 26:
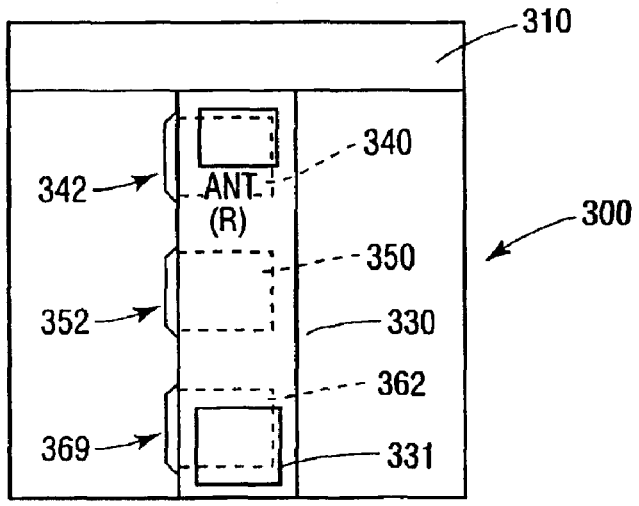
FIG. 26 is a rear view of the antenna pointing apparatus of FIGS. 24 and 25.

The mounting base 310 includes an attachment surface 312 that has a first pin 314 attached thereto that is sized to be inserted into the hole 82 in the first socket 80. A second pin 316 is attached to the mounting base 310 such that it is received in the second hole 86 in the second socket 84 when the first pin 314 is received in the hole 82 in the first socket 80. The centerlines of the first and second pins are located on a common axis G'—G'. See FIG. 25. A third movable pin assembly 320 is also provided in the mounting base 310 as shown in FIGS. 24 and 26. In this embodiment, the movable pin assembly 320 includes a pin 322 that is attached to a movable support member 324 that is slidably received within a hole 326 provided in the mounting base 310. The third pin 322 protrudes through a slot 328 in the mounting base 310 as shown in FIGS. 24 and 25. A biasing member in the form of a compression spring 329 is provided in the hole 326 and serves to bias the third pin 322 in the direction represented by arrow "I". The centerline H'—H' of the third movable pin 322 is perpendicular to and intersects axis G'—G' at point 92' as shown in FIG. 25.

To attach the mounting base 310 to the antenna reflector 30, the installer inserts the third pin 322 into the third hole 90 and applies a biasing force to the pointing device 300 until the first pin 314 may be inserted into the first hole 82 in first socket 80 and the second pin 316 may be inserted into the second hole 86 in the second socket 84. When pins (314, 316, and 322) have been inserted into their respective holes (82, 86, 90), the spring 329 applies a biasing force against the support member 310 that, in turn, biases the third pin 322 into frictional engagement with the inner surface of the third hole 90 in the third socket 88 to removably affix the pointing device 300 to the antenna reflector 30. When affixed to the antenna reflector 30 in that manner (see FIG. 28), the distance "d" between point 92' and point 92 through which the centerline axis A—A of the antenna reflector 30 extends is input into the microprocessor 367 by a keypad or other standard input device to enable the microprocessor 367 to calculate and display the skew angle θ on the digital skew meter display 369. See FIG. 27A. In this embodiment, the digital compass 340 and the first and second digital levels 350 and 362, respectively are powered by a battery (not shown) supported in the housing 330. The battery may be rechargeable or comprise a replaceable battery or batteries. The housing 330 is provided with a battery access door 331 to permit the installation and replacement of batteries. However, it is conceivable that other compasses and digital levels that require alternating current may be employed.

Figure 28A:
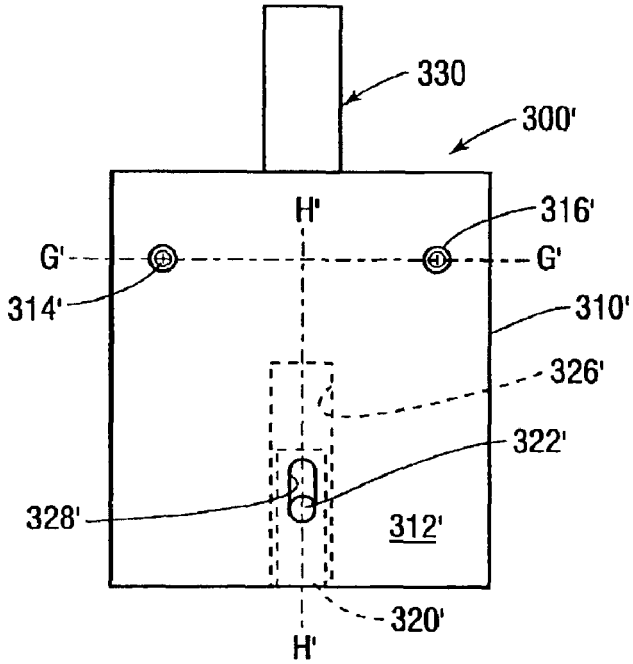
FIG. 28A is a rear view of another embodiment of the present invention.
Figure 28B:
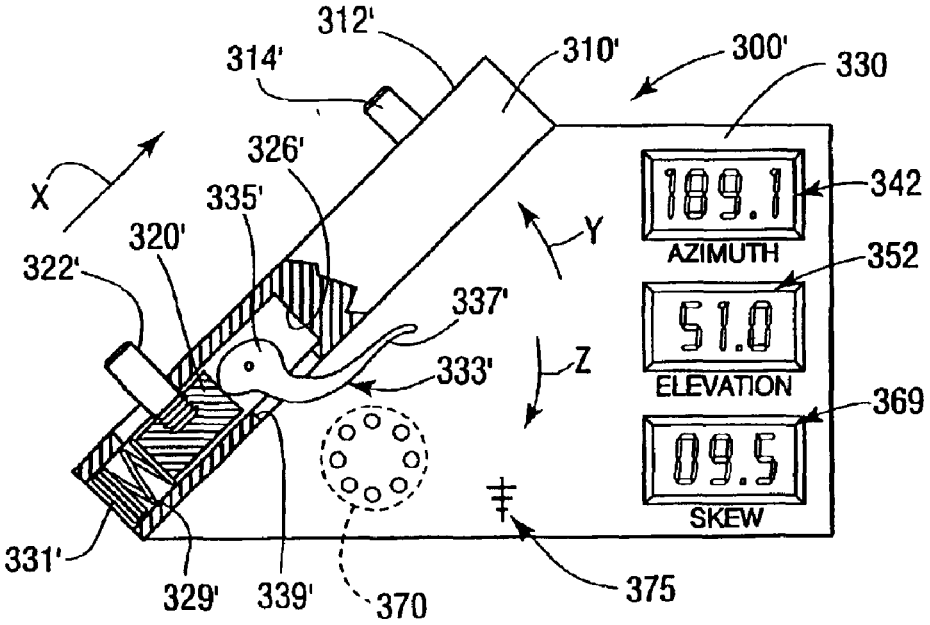
FIG. 28B is a side elevational view of the embodiment depicted in FIG. 28A.

An alternative method of attaching an embodiment of the antenna-pointing device 100' of the present invention is depicted in FIGS. 28A and 28B. The only difference in this embodiment, from the embodiment described above and depicted in FIGS. 24–28 is the method of attaching the mounting base 310' to the reflector 30. As can be seen in FIGS. 28A and 28B, the mounting base 310' includes an attachment surface 312' that has a first pin 314' attached thereto that is sized to be inserted into the hole 82 in the first socket 80. A second pin 316' is attached to the mounting base 310' such that it is received in the second hole 86 in the second socket 84 when the first pin 314' is received in the hole 82 in the first socket 80. The centerlines of the first and second pins are located on a common axis G'—G'. See FIG. 28A. A third movable pin assembly 320' is also provided in the mounting base 310'. In this embodiment, the movable pin assembly 320' includes a pin 322' that is attached to a movable support member 324' that is slidably received within a hole 326' provided in the mounting base 310'. The third pin 322' protrudes through a slot 328' in the mounting base 310' as shown in FIGS. 28A and 28B. A biasing member in the form of a compression spring 329' is provided in the hole 326' and serves to bias the third pin 322' in the direction represented by arrow "X". The centerline H'—H' of the third movable pin 322' is perpendicular to and intersects axis G'—G' at point 92' as shown in FIG. 28A. To facilitate installation of the movable support assembly 320' and compression spring 329' within the hole 326', one end of the hole 326' may be threaded to receive a threaded cap 331'. See FIG. 28B. Also in this embodiment, a locking lever 333' that has a cam-shaped end 335' is pivotally pinned to the mounting base 310'. An actuation portion 337' protrudes through a slot 339' in the mounting base 310'.

To attach the mounting base 310' to the antenna reflector 30, the installer inserts the third pin 322' into the third hole 90 and applies a biasing force to the pointing device 300' until the first pin 314' may be inserted into the first hole 82 in first socket 80 and the second pin 316' may be inserted into the second hole 86 in the second socket 84. When pins (314', 316', and 322') have been inserted into their respective holes (82, 86, 90), the installer pivots the actuation portion 337' of the locking lever 333' in the direction represented by arrow "Y" in FIG. 28B to bias the pin 322' into frictional engagement with the inner surface of the third hole 90 in the third socket 88 to removably affix the pointing device 300' to the antenna reflector 30. To remove the device 300' from the reflector 30, the user simply pivots the actuation portion 337' in the direction represented by arrow "Z" in FIG. 28B. The antenna pointing device 300' is otherwise used in the same manner as described herein with respect to the antenna pointing device 300. The skilled artisan will further appreciate that other methods of attaching the antenna-pointing device 300 to the rear of the antenna reflector 30 may be employed without departing from the spirit and scope of the present invention.

The antenna-pointing device 300 may be employed to align the antenna's centerline axis A—A with the satellite as follows. After the mounting member 110 has been mounted to a support structure, the antenna mast 15 is inserted into the mast-receiving socket 192 in the mast support member 190. Antenna mast 15 may be retained in the socket 192 by one or more retaining screws 193 that are threaded into engagement with the antenna mast 15. See FIG. 11. However, other fasteners and attachment methods may be employed for affixing the antenna mast 15 to the antenna mast support member 190. In this embodiment, the antenna 20 is connected to the mounting mast 15 by a rearwardly extending portion 44 of the support arm 40. A socket 46 is provided in the rearwardly extending portion 44 for receiving the other end of the antenna mast 15 therein. The mast 15 is retained in the socket 46 by locking screws 47. See FIGS. 3 and 12.

After the antenna 20 has been preliminarily mounted to the mounting bracket 100 as described above, the antenna-pointing device 300 is snapped onto the rear of the antenna reflector 30 in the above-described manner. Because the antenna-pointing device 300 is affixed to the rear of the reflector 30, the installer's hands are free to adjust the antenna 20 and mounting bracket 100.

Upon attachment of the antenna-pointing device 300 to the reflector 30, the digital azimuth display 342 will display the azimuth reading for the antenna's initial position. The installer then loosens the lock screws 166, 172, 174, 176. Thereafter, the first adjustment bolt 181 is rotated in the appropriate direction to cause the support member 140 to pivot in a desired direction about the first pivot axis G—G. Such rotation of the first adjustment bolt 181 causes the pivoting of the support member 140 (and the antenna 20) about the first pivot axis G—G in a controlled manner. The installer rotates the first adjustment member 181 until the azimuth display 342 displays the desired azimuth reading. Thereafter, the lock screws 166, 172, 174, 176 are screwed into lock the support member 140 in that position. Those of ordinary skill in the art will appreciate that the mounting bracket serves to retain the antenna 20 in the desired azimuth setting while the above-mentioned fasteners are locked.

To set the antenna's elevation, the installer observes the elevation reading displayed by the elevation display meter 352. Thereafter, the lock nut 198 and the lock nut 210 are loosened. The second adjustment bolt 222 is then rotated in the appropriate direction to cause the mast support member 190 (and the antenna 20) to pivot in the desired direction about the second pivot axis J—J in a controlled manner. After the antenna meter indicates that the antenna has been oriented at the desired elevation, the lock nuts (198, 210) are screwed into locking position. Those of ordinary skill in the art will appreciate that the second adjustment assembly, by virtue of the threaded engagement of the second pivot bar 240 with the second adjustment bolt 222, serves to positively retain the mast support member 190 in the desired position while the lock nuts (198, 210) are tightened to rigidly retain the mast support member 190 in that position.

In the antenna design depicted in FIGS. 1–3, the antenna's centerline axis A—A is coaxially aligned with the center of the antenna mounting mast 14 and the mast-receiving socket 192 in the mast-support member 190. Thus, such arrangement permits the antenna 20 to be readily adjusted for satellite skew by loosening the retaining screws 193 and rotating the mounting mast (and antenna 20 attached thereto) within the mast-receiving socket 192 until the desired skew orientation is displayed by the skew meter display 369 Thereafter, the retaining screws 193 are screwed into engage the antenna mast 15 and retain it in that position. It will be further understood that the antenna pointing device 300 may also be used with other antennas that are mounted utilizing conventional mounting brackets and support apparatuses. The order of antenna adjustments described herein is illustrative only. Those of ordinary skill in the art will appreciate that the installer could, for example, set the skew first or the elevation first when orienting the antenna 20.

If the installer wishes to employ a set top box 60 to further optimize the antenna's alignment with the satellite 14, a coaxial cable 62 is attached to the feed/LNBF assembly 45 and the set top box 60. The antenna's position is further adjusted in the above-described manners while monitoring the graphical display on the television 48 and the audio signal emitted by the set top box.

Figure 24A:
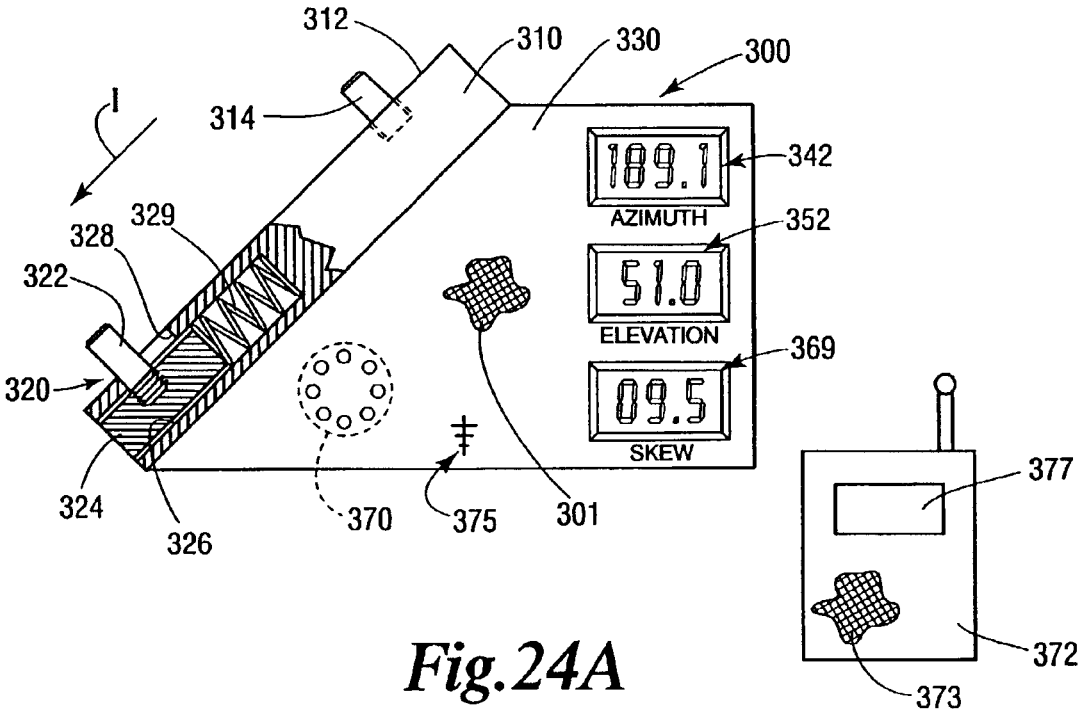
FIG. 24A is a side elevational view of another embodiment of an alignment apparatus of the present invention showing a portion of the mounting member in cross-section and a transmitter therefor.

Another embodiment of the antenna pointing apparatus 300 of the present invention employs a speaker 370 that is supported on housing 330 and has a radio receiver antenna 375. This embodiment further includes a conventional transmitter 372 that is equipped with a conventional microphone 377. Transmitter 372 may be powered by batteries (not shown). Speaker 370 and transmitter 372 may be constructed of radio components like those sold as infant monitoring devices by Tandy Corporation and others or similar devices may be successfully employed. Those speakers 370 that employ a magnet should be mounted within the housing such that the magnet does not interfere with the operation of the digital or analog compass that may also be supported within the housing 330. Appropriate shielding means could also be employed. To use the speaker 370 and transmitter 372, the user places the transmitter 372 adjacent to the television's audio speaker 49 such that it can receive and transmit the audio signals emitted during use of the set top box 60 to the speaker 370. The antenna-pointing device 300 is attached to the rear of the antenna reflector 30 in the above-described manner and further positioning adjustments are made to the antenna 20 until the emitted audio signal indicates that the optimum orientation has been achieved. Those of ordinary skill in the art will appreciate that most set top boxes emit a repeating tone at a frequency that increases as the satellite signal improves until the series of tones becomes a single tone. The antenna 20 is then retained in that position by locking the appropriate adjustment screws on the mounting bracket. Those of ordinary skill in the art will readily appreciate that such arrangement permits an individual installer to employ the set top box to achieve optimum positioning of the reflector without having to make several trips between the antenna and the television. To make the transmitter easy to locate and thus prevent it from becoming misplaced or lost during installation, it may be provided in a bright color, such a florescent orange, red, yellow, etc. In addition, to enable the installer to quickly identify which transmitter 372 corresponds to a particular antenna alignment device 300, the alignment device may be provided with a first bright color 301, such as, for example, fluorescent orange, red, yellow, etc. and the transmitter 372 may be provided in a second color 373 that is identical to the first color 301. See FIG. 24A.

Figure 29:
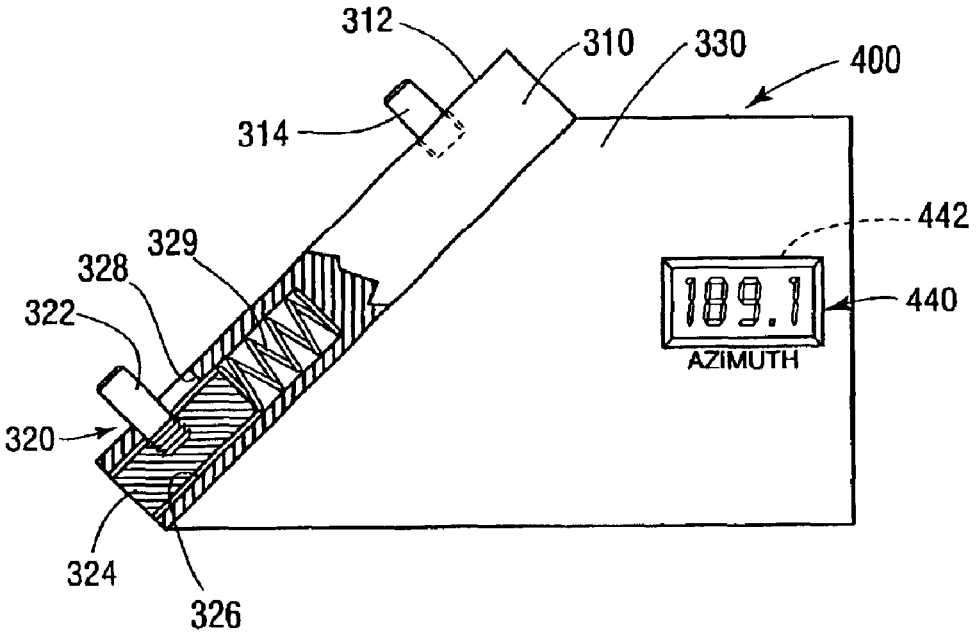
FIG. 29 is a side elevational view of another antenna pointing apparatus showing a portion of the mounting member in cross-section.
Figure 30:
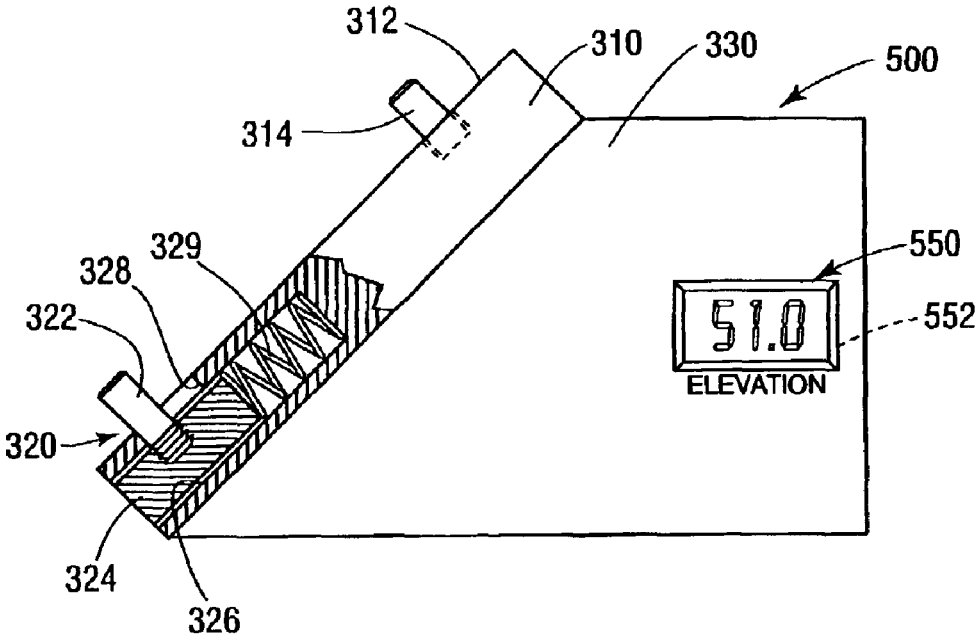
FIG. 30 is a side elevational view of another antenna pointing apparatus showing a portion of the mounting member in cross-section.
Figure 31:
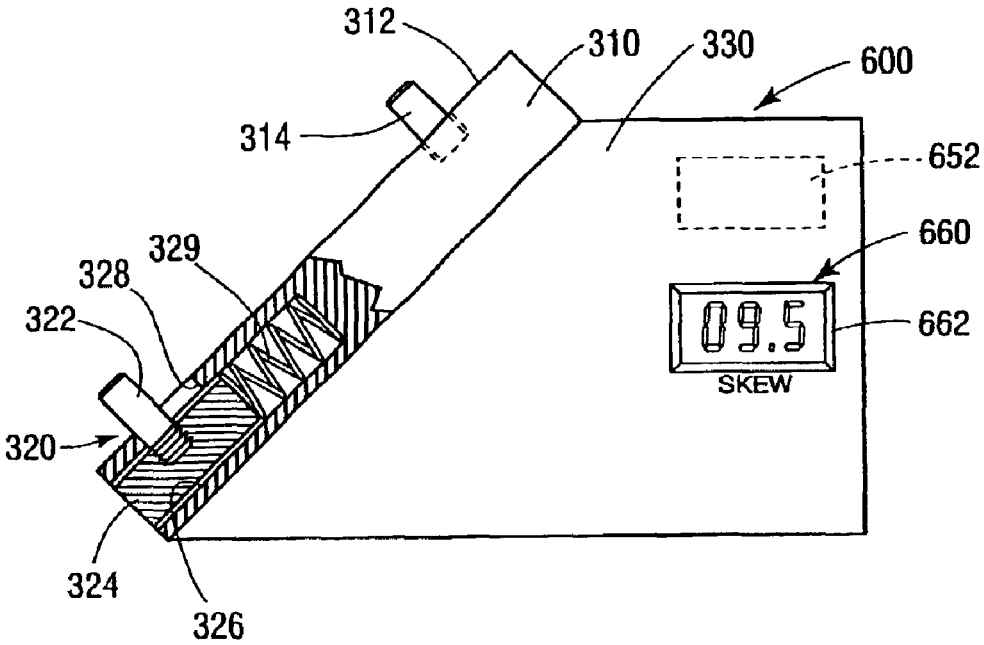
FIG. 31 is a side elevational view of another antenna pointing apparatus showing a portion of the mounting member in cross-section.
Figure 32:
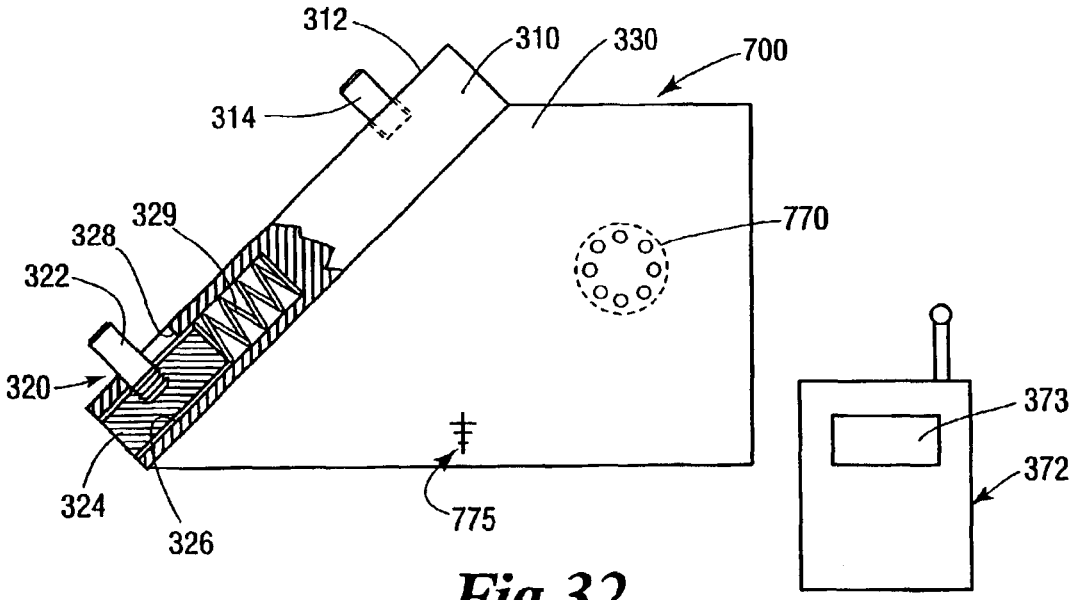
FIG. 32 is a side elevational view of another antenna pointing apparatus showing a portion of the mounting member in cross-section.

The antenna alignment apparatuses of the present invention may comprise one or more of the following components: (i) digital compass, (ii) a first digital level, (iii) a second digital level, and/or (iv) a speaker. For example, as shown in FIG. 29, the antenna pointing device 400 is substantially identical to the antenna pointing devices described above, except that device 400 only includes an azimuth meter 440 that consists of a digital compass 340 that has a digital display 442. The device 400 may be removably affixed to the rear surface 32 of the antenna reflector 30 in the manner described above. However, the device 400 will only provide an azimuth reading for the antenna 20. Similarly, as shown in FIG. 30, the antenna alignment device 500 is substantially identical to the antenna pointing devices 300 described above, except that the device 500 only includes an elevation meter 550 comprising one digital level 552. The device 500 may be removably affixed to the rear surface 32 of the antenna reflector 30 in the manner described above. However, the alignment device 500 will only provide an elevation reading for the antenna 20. The antenna alignment device 600 as shown in FIG. 31 has a skew meter 660 that displays a skew setting that is generated by two digital levels (352, 652) arranged perpendicular to each other and cooperate in the above-described manner to emit a display that is indicative of the skew of the antenna 20. The alignment device 600 is otherwise removably attachable to the antenna reflector 30, but it will only provide a skew reading for the antenna 20. The alignment device 700 illustrated in FIG. 32 is substantially identical to the antenna alignment device 300 described above, except that it is only equipped with the speaker 770 and a radio receiver 775. Thus, this alignment device 700 is removably attachable to the rear surface 32 of the antenna reflector 30 in the manner described above. However, alignment device 700 employs the speaker 770 to receive the tones emitted from the television speaker and transmitted by a transmitter 372 equipped with a microphone 373 placed adjacent to the television speaker 49. The skilled artisan will appreciate that each of the above-described embodiments may be removably attached to the rear surface 32 of an antenna reflector 30 in a variety of other suitable manners.

Figure 33:
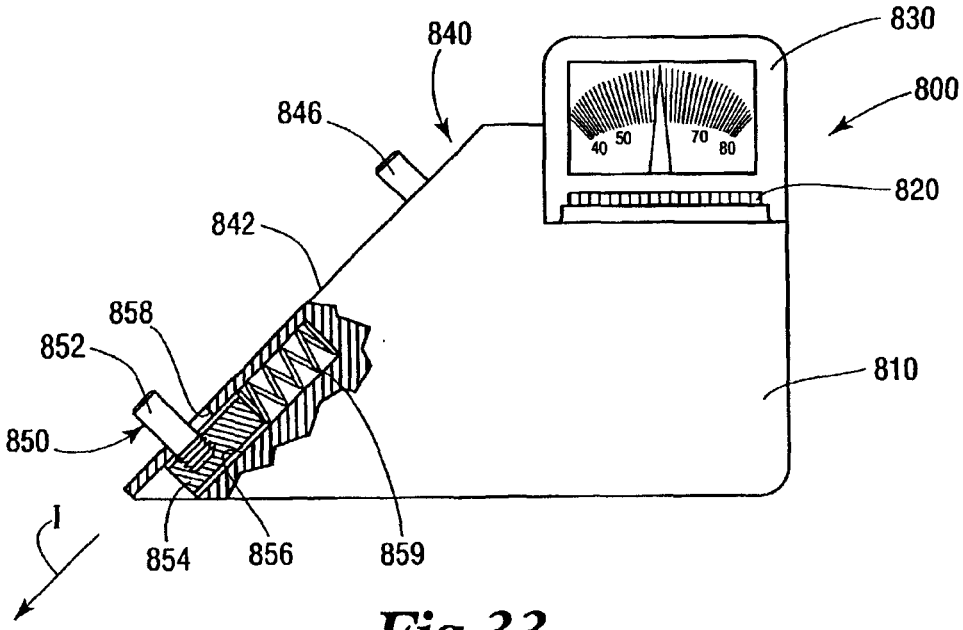
FIG. 33 is a side elevational view of another antenna pointing apparatus with a portion thereof shown in cross-section.
Figure 34:
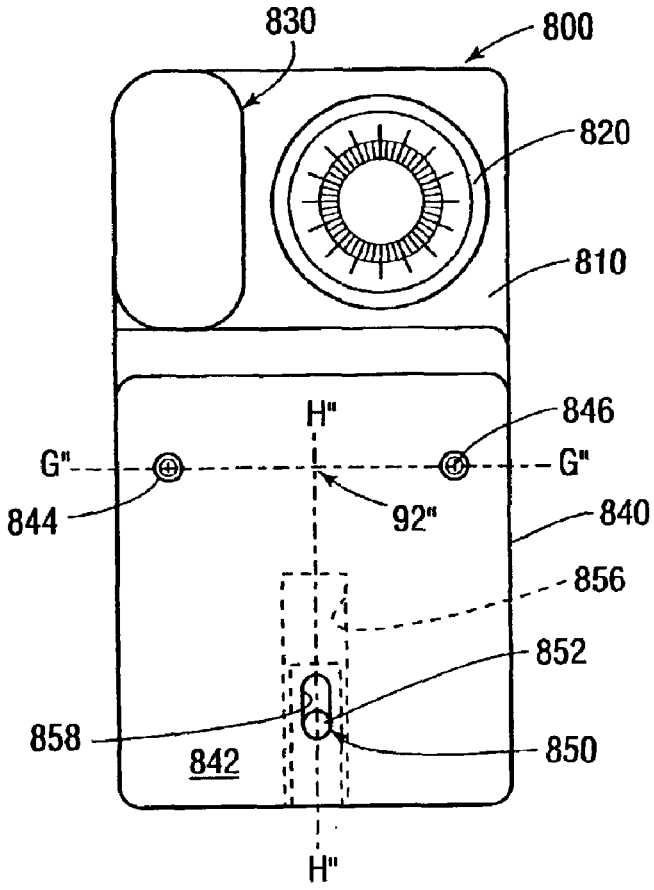
FIG. 34 is a top view of the antenna pointing apparatus depicted in FIG. 33.
Figure 34A:
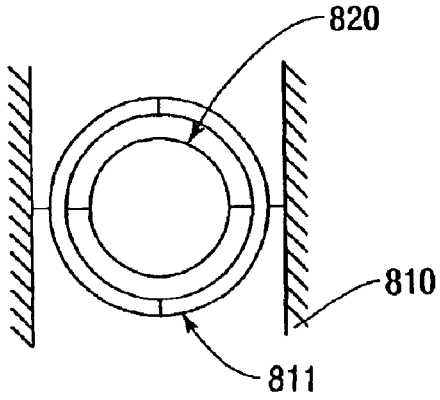
FIG. 34A is a partial top view of the antenna pointing apparatus depicted in FIGS. 33 and 34 illustrating a gimball mounting arrangement.
Figure 35:
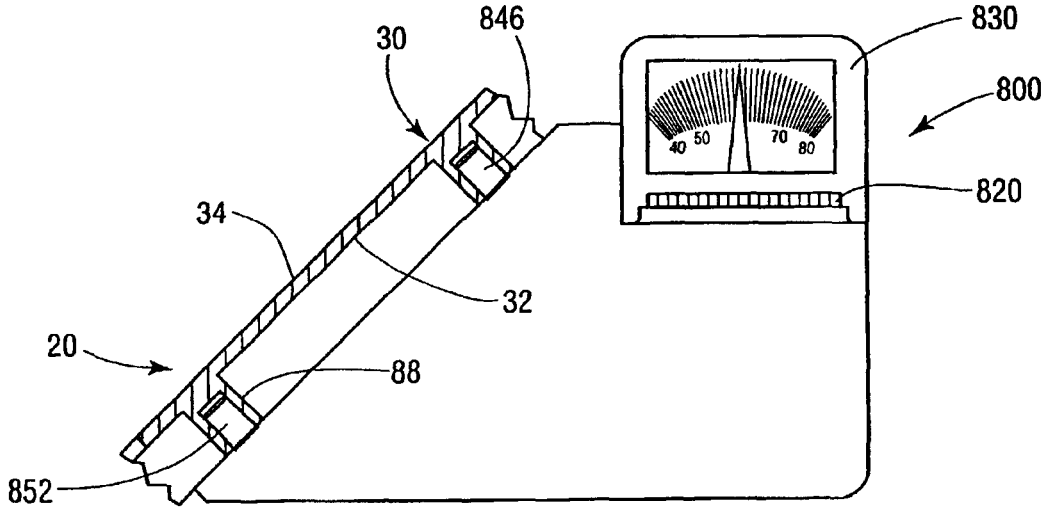
FIG. 35 is a side elevational view of the antenna pointing apparatus of FIGS. 33 and 34 attached to a rear portion of an antenna reflector with the portion of the reflector shown in cross-section.

FIGS. 33–35 illustrate another embodiment of the present invention. In that embodiment, the antenna pointing apparatus 800 includes a housing 810 that supports an analog compass 820 and an analog level 830 therein. Housing 810 may be fabricated from plastic. However, housing 810 may be fabricated from a variety of other suitable materials. Compass 820 comprises any conventional analog compass such as, for example, those analog compasses employed in surveying apparatuses such as those manufactured by Bosch. The compass 820 is mounted in a conventional gimball mount 811 such that it remains level. The gimball mount 811 may be retained within the housing 810 by a frictional fit. See FIG. 34A. The level 830 may comprise any conventional analog level such as, those employed in conventional surveying apparatuses. The analog level is mounted in housing 810 such that its centerline is within the plane defined by the reflector's centerline A—A and its minor axis B"—B".

The housing 810 further has an attachment portion 840 for attaching the antenna-pointing device 800 to the rear surface 32 of the antenna reflector 30. More particularly and with reference to FIGS. 33 and 34, the attachment portion 840 includes an attachment surface 842 that has a first pin 844 attached thereto that is sized to be inserted into the hole 82 in the first socket 80. A second pin 846 is attached to the attachment portion 840 such that it is received in the second hole 86 in the second socket 84 when the first pin 844 is received in the hole 82 in the first socket 80. The centerlines of the first and second pins (844, 846) are located on a common axis G"—G". See FIG. 34. A third movable pin assembly 850 is also provided in the attachment portion 840 as shown in FIG. 33. In this embodiment, the movable pin assembly 850 includes a pin 852 that is attached to a movable support member 854 that is slidably received within a hole 856 provided in the attachment portion 840. The third pin 852 protrudes through a slot 858 in the attachment portion 840. A compression spring 859 is provided in the hole 856 and serves to bias the third pin 852 in the direction represented by arrow "I". The centerline H"—H" of the third movable pin 852 is perpendicular to and intersects axis G"—G" at point 92" as shown in FIG. 34.

To attach the attachment portion 840 to the antenna reflector 30, the installer inserts the third pin 852 into the third hole 90 and applies a biasing force to the pointing device 800 until the first pin 844 may be inserted into the first hole 82 in first socket 80 and the second pin 846 may be inserted into the second hole 86 in the second socket 84. When pins (844, 846 and 852) have been inserted into their respective holes (82, 86, 90), the spring 859 applies a biasing force against the movable support member 854 that, in turn, biases the third pin 852 into frictional engagement with the inner surface of the third hole 90 in the third socket 88 to removably affix the pointing device 800 to the antenna reflector 30. When affixed to the antenna reflector 30 in that manner (see FIG. 32), the point 92" is superimposed over point 92 through which the centerline axis A—A of the antenna reflector 30 extends. The skilled artisan will further appreciate that other methods of attaching the antenna-pointing device 800 to the rear portion of the antenna reflector 30 may be employed without departing from the spirit and scope of the present invention.

The antenna-pointing device 800 may be employed to align the antenna's centerline axis A—A with the satellite as follows. After the antenna-mounting bracket 800 has been installed, the antenna 20 is affixed to the mounting bracket 100 in the above-described manner. After the antenna 20 has been preliminarily mounted to the mounting bracket 100, the antenna-pointing device 800 is snapped onto the rear of the antenna reflector 30 in the above-described manner. Because the antenna-pointing device 800 is affixed to the rear of the reflector 30, the installer's hands are free to adjust the antenna until it has been set at a desired azimuth and elevation. Upon attachment to the reflector, the compass 820 will display the azimuth reading for the antenna's initial position. The installer then adjusts the antenna's position until the compass 820 displays the desired azimuth reading. The antenna is then locked in that position. The installer then observes the elevation reading displayed by the level 830 and adjusts the position of the antenna until the level 830 displays the desired reading and the antenna 20 is locked in that position. It will be understood that the antenna-pointing device 800 may also be used with other antennas that are mounted utilizing conventional mounting brackets and support apparatuses. The order of antenna adjustments described herein is illustrative only. Those of ordinary skill in the art will appreciate that the installer could, for example, set the elevation first when orienting the antenna 20.

If the installer wishes to employ a set top box 60 to further optimize the antenna's alignment with the satellite 14, a coaxial cable 62 is attached to the feed/LNBF assembly 45 and the set top box 60. The antenna's position is further adjusted while monitoring the graphical display on the television 48 and the audio signal emitted by the set top box.

Thus, from the foregoing discussion, it is apparent that the present invention solves many of the problems encountered by prior antenna alignment devices and methods. In particular, the methods of the present invention are easy to employ and can be employed by one installer to quickly and accurately align an antenna with a satellite. Various methods of the present invention also include the use of a set top box to optimize the antenna's orientation without the need to make several trips between the antenna and the television to which the set top box is attached. Those of ordinary skill in the art will, of course, appreciate that various changes in the details which have been herein described and illustrated in order to explain the nature of the invention may be made by the skilled artisan within the principle and scope of the invention as expressed in the appended claims.

What is claimed is:

1. A method of aligning an antenna reflector with a satellite, comprising:

inserting a pin protruding from a compass into a hole in the antenna reflector;

inserting another pin that is movably coupled to the compass into another hole in the antenna reflector;

biasing the another pin into retaining engagement with a portion of the antenna reflector surrounding the another hole;

moving the antenna reflector to a position wherein the compass displays a reading that corresponds to a predetermined azimuth reading associated with the satellite; and retaining the antenna reflector in said position.

2. A method of aligning an antenna with a satellite, said method comprising:

attaching a level to a rear portion of the antenna;

orienting the antenna in a position wherein the first digital level displays a reading that corresponds to a predetermined elevation reading associated with the satellite; and retaining the antenna in said position.

3. Te method of claim 2 wherein said attaching a level comprises attaching a digital level to a rear portion of the antenna.

4. The method of claim 2 further comprising detaching the level from the rear portion of the antenna.

5. A method for aligning an antenna with a satellite, said method comprising:

attaching a compass and a level to a rear portion of the antenna;

orienting the antenna about a first axis to a first orientation wherein the compass displays a reading that corresponds to a predetermined azimuth reading associated with the satellite;

retaining the antenna in the first orientation about the first axis;

orienting the antenna about a second axis to a second orientation until the level displays a reading that corresponds to a predetermined elevation reading associated with the satellite; and retaining the antenna in the second orientation about the second axis.

6. The method of claim 5 wherein said attaching a compass and level comprises attaching a digital compass and a digital level to the antenna.

7. The method of claim 5 further comprising detaching the compass and level from the antenna.

8. A method of aligning a centerline of an antenna with a satellite, wherein the antenna has a feed/LNBF assembly that is electronically coupled to a set top box which is electronically coupled to a television having a television speaker therein, said method comprising:

affixing an audio speaker to the antenna;

operating the set top box and television such that a series of tones are emitted from the television speaker which are indicative of the alignment of the antenna centerline with the satellite;

transmitting the series of tones to the audio speaker affixed to the antenna; and positioning the antenna until the series of tones being transmitted to the speaker affixed to the antenna has a desired frequency.

9. The method of claim 8 wherein said transmitting comprises placing a transmitter adjacent to the television speaker, said transmitter transmitting the tones emitted from the television speaker to the speaker affixed to the antenna.

10. A method of aligning a centerline of an antenna with a satellite, wherein the antenna has a feed/LNBF assembly that is electronically coupled to a set top box which is electronically coupled to a television having a television speaker therein, said method comprising:

attaching a compass, a level and a speaker to the antenna;

orienting the antenna about a first axis to a first orientation wherein the compass displays a reading that corresponds to a predetermined azimuth reading associated with the satellite;

retaining the antenna in the first orientation about the first axis;

orienting the antenna about a second axis to a second orientation until the level displays a reading that corresponds to a predetermined elevation reading associated with the satellite;

retaining the antenna in the second orientation about the second axis;

operating the set top box and television such that a series of tones are emitted from the television speaker which are indicative of the alignment of the antenna centerline with the satellite;

transmitting the series of tones to the audio speaker affixed to the antenna;

reorienting the antenna about the first and second axes as necessary to a final orientation wherein the series of tones being transmitted to the speaker affixed to the antenna have a desired frequency; and locking the antenna in the final orientation.

11. The method of claim 10 wherein said transmitting comprises placing a transmitter adjacent to the television speaker, said transmitter transmitting the tones emitted from the television speaker to the speaker affixed to the antenna.

12. A method for aligning an antenna with a satellite, said method comprising:

attaching an alignment device that has first and second digital levels therein to the antenna, the first and second digital levels cooperating to display a reading indicative of the antenna's skew orientation;

orienting the antenna about a first axis to a first orientation wherein the first digital level displays a reading that corresponds to a predetermined elevation reading associated with the satellite;

retaining the antenna in the first orientation;

further orienting the antenna to another position wherein the first and second digital levels produce a skew reading that corresponds to a predetermined skew reading; and locking the antenna in the another position.

13. The method of claim 12 wherein the antenna is retained in the first orientation while performing said further orienting.

14. A method for aligning an antenna with a satellite, said method comprising:

attaching an alignment device that has a compass and first and second digital levels therein to the antenna, the first and second digital levels cooperating to display a reading indicative of the antenna's skew orientation;

orienting the antenna about a first axis to a first orientation wherein the compass displays a reading that corresponds to a predetermined azimuth reading associated with the satellite;

retaining the antenna in the first orientation about the first axis;

orienting the antenna about a second axis to a second orientation until the first digital level displays a reading that corresponds to a predetermined elevation reading associated with the satellite;

retaining the antenna in the second orientation about the second axis;

further orienting the antenna to a third orientation wherein the first and second digital levels cooperate to produce a skew reading that corresponds to a predetermined skew reading; and locking the antenna in the first, second and third orientations.

15. A method of aligning a centerline of an antenna with a satellite, wherein the antenna has a feed/LNBF assembly that is electronically coupled to a set top box which is electronically coupled to a television having a television speaker therein, said method comprising:

attaching an alignment device that has a compass, a speaker, and first and second digital levels therein to the antenna, the first and second digital levels cooperating to display a reading indicative of the antenna's skew orientation;

orienting the antenna about a first axis to a first orientation wherein the compass displays a reading that corresponds to a predetermined azimuth reading associated with the satellite;

retaining the antenna in the first orientation about the first axis;

orienting the antenna about a second axis to a second orientation until the first digital level displays a reading that corresponds to a predetermined elevation reading associated with the satellite;

retaining the antenna in the second orientation about the second axis;

further orienting the antenna to a third orientation position wherein the first and second digital levels produce a skew reading that corresponds to a predetermined skew reading;

retaining the antenna in the third orientation;

operating the set top box and television such that a series of tones are emitted from the television speaker which are indicative of the alignment of the antenna centerline with the satellite;

transmitting the series of tones to the audio speaker;

reorienting the antenna as necessary to a final orientation wherein the series of tones being transmitted to the speaker affixed to the antenna have a desired frequency; and locking the antenna in the final orientation.

16. The method of claim 15 wherein said transmitting comprises placing a transmitter adjacent to the television speaker, said transmitter transmitting the tones emitted from the television speaker to the speaker.

17. A method for aligning an antenna with a satellite, said method comprising:

mounting an adjustable mounting bracket to a structure;

supporting the antenna in the mounting bracket;

attaching a level to a rear portion of the antenna;

pivoting a portion of the mounting bracket until the antenna is in a position wherein the level displays a reading that corresponds to a predetermined elevation reading associated with the satellite; and locking the portion of the mounting bracket to prevent further movement thereof.

18. The method of claim 17 further comprising mechanically retaining the antenna in the position prior to said locking.

19. The method of claim 17 wherein said mounting an adjustable mounting bracket comprises attaching a portion of the adjustable mounting bracket to a vertically extending wall of a building.

20. The method of claim 17 wherein said mounting an adjustable mounting bracket comprises attaching a portion of the adjustable mounting bracket to a tree.

21. The method of claim 17 wherein said mounting an adjustable mounting bracket comprises affixing a portion of the adjustable mounting bracket to a vertically extending mast.

22. A method for aligning an antenna with a satellite, said method comprising:

mounting an adjustable mounting bracket to a structure, the adjustable mounting bracket having a movable first portion and a movable second portion attached to the movable first portion;

supporting the antenna in the movable second portion of the mounting bracket;

attaching a compass and a level to a rear portion of the antenna;

pivoting the first portion of the adjustable mounting bracket about a first pivot axis until the antenna is in a first orientation wherein the compass displays a reading that corresponds to a predetermined azimuth reading associated with the satellite;

locking the first portion of the adjustable mounting bracket to prevent further movement thereof;

pivoting the second portion of the adjustable mounting bracket about a second pivot axis until the antenna is in a second orientation wherein the level displays a reading that corresponds to a predetermined elevation reading associated with the satellite; and locking the second portion to prevent further movement thereof.

23. A method for aligning an antenna with a satellite, said method comprising:

mounting an adjustable mounting bracket to a structure, the adjustable mounting bracket having a movable first portion and a movable second portion attached to the movable first portion;

supporting the antenna in the second portion of the mounting bracket;

attaching a compass and a level to a rear portion of the antenna;

pivoting the first portion of the adjustable mounting bracket about a first pivot axis to a first position wherein the antenna is in a first orientation wherein the compass displays a reading that corresponds to a predetermined azimuth reading associated with the satellite;

retaining the first portion of the adjustable mounting bracket in the first position;

pivoting the second portion of the adjustable mounting bracket about a second pivot axis to a second position wherein the antenna is in a second orientation wherein the level displays a reading that corresponds to a predetermined elevation reading associated with the satellite; and retaining the second portion of the adjustment bracket in the second position;

locking the first portion of the adjustment bracket in the first position; and locking the second portion of the adjustment bracket in the second portion.

24. A method of aligning a centerline of an antenna with a satellite, wherein the antenna has a feed/LNBF assembly that is electronically coupled to a set top box which is electronically coupled to a television having a television speaker therein, said method comprising:

mounting an adjustable mounting bracket to a structure;

supporting the antenna in the mounting bracket;

affixing an audio speaker to the antenna;

operating the set top box and television such that a series of tones are emitted from the television speaker which are indicative of the alignment of the antenna centerline with the satellite;

transmitting the series of tones to the audio speaker affixed to the antenna;

pivoting first and second portions of the mounting bracket as necessary to orient the antenna in a position which causes the series of tones being transmitted to the speaker to have a desired frequency; and locking the first and second portions of the adjustment bracket to prevent further movement thereof.

25. A method of aligning a centerline of an antenna with a satellite, wherein the antenna has a feed/LNBF assembly that is electronically coupled to a set top box which is electronically coupled to a television having a television speaker therein, said method comprising:

mounting an adjustable mounting bracket to a structure;

supporting the antenna in the mounting bracket;

attaching a compass, a level and a speaker to the antenna;

moving a first portion of the adjustable mounting bracket to a first position wherein the antenna is in a first orientation about a first axis wherein the compass displays a reading that corresponds to a predetermined azimuth reading associated with the satellite;

retaining the first portion of the adjustable mounting bracket in the first position;

moving a second portion of the adjustable mounting bracket to a second position wherein the antenna is in a second orientation about a second axis wherein the level displays a reading that corresponds to a predetermined elevation reading associated with the satellite;

retaining the second portion of the adjustable mounting bracket in the second position;

operating the set top box and television such that a series of tones are emitted from the television speaker which are indicative of the alignment of the antenna centerline with the satellite;

transmitting the series of tones to the audio speaker affixed to the antenna;

reorienting the first and second portions of the adjustable mounting bracket as necessary to orient the antenna in a final position wherein the series of tones being transmitted to the speaker have a desired frequency; and locking the first and second portions of the adjustable mounting bracket to prevent further movement thereof.

26. A method for aligning an antenna having a centerline with a satellite, said method comprising:

mounting an adjustable mounting bracket to a structure;

affixing an end of a mast to the antenna such that the mast is coaxially aligned with the centerline of the antenna;

supporting another end of the mast in a portion of the adjustable mounting bracket;

attaching an alignment device that has first and second digital levels therein that cooperate to display a reading indicative of the antenna's skew orientation to the antenna;

pivoting the portion of the adjustable mounting bracket to a first position wherein the antenna is oriented in a first orientation wherein the first digital level displays a reading that corresponds to a predetermined elevation reading associated with the satellite;

retaining the portion of the first adjustable mounting member in the first position;

rotating the another end of the mast within the portion of the adjustable mounting bracket to a second position wherein the first and second digital levels produce a skew reading that corresponds to a predetermined skew reading associated with the satellite; and locking the another end of the mast in the second position within the portion of the adjustable mounting bracket.

27. A method for aligning an antenna with a satellite, said method comprising:

mounting an adjustable mounting bracket to a structure, the adjustable mounting bracket having a first movable portion and a second movable portion attached to the first movable portion;

affixing an end of a mast to the antenna such that the mast is coaxially aligned with the centerline of the antenna;

supporting another end of the mast in the second movable portion of the adjustable mounting bracket;

attaching an alignment device that has a compass and first and second digital levels therein that cooperate to display a reading indicative of the antenna's skew orientation to the antenna;

moving the first movable portion of the adjustable mounting bracket about a first axis to a first position wherein the antenna is oriented in a first orientation wherein the compass displays a reading that corresponds to a predetermined azimuth reading associated with the satellite;

retaining the first movable portion in the first position;

moving the second movable portion of the adjustable mounting bracket about a second axis to a second position wherein the antenna is oriented in a second orientation wherein the first digital level displays a reading that corresponds to a predetermined elevation reading associated with the satellite;

retaining the second portion of the adjustable mounting bracket in the second position;

rotating the another end of the mast within the second portion of the adjustable mounting bracket until the antenna is in a third orientation wherein the first and second digital levels produce a skew reading that corresponds to a predetermined skew reading; and locking the antenna in the first, second and third orientations.

28. A method of aligning a centerline of an antenna with a satellite, wherein the antenna has a feed/LNBF assembly that is electronically coupled to a set top box which is electronically coupled to a television having a television speaker therein, said method comprising:

mounting an adjustable mounting bracket to a structure, the adjustable mounting bracket having a first movable portion and a second movable portion attached to the first movable portion;

affixing an end of a mast to the antenna such that the mast is coaxially aligned with the centerline of the antenna;

supporting another end of the mast in the second movable portion of the adjustable mounting bracket;

attaching an alignment device that has a compass, a speaker, and first and second digital levels therein wherein the first and second digital levels cooperate to display a reading indicative of the antenna's skew orientation to the antenna;

moving the first movable portion of the adjustable mounting bracket about a first axis to a first position wherein the antenna is oriented in a first orientation wherein the compass displays a reading that corresponds to a predetermined azimuth reading associated with the satellite;

retaining the first movable portion in the first position;

moving the second movable portion of the adjustable mounting bracket about a second axis to a second position wherein the antenna is oriented in a second orientation wherein the first digital level displays a reading that corresponds to a predetermined elevation reading associated with the satellite;

rotating the another end of the mast within the second portion of the adjustable mounting bracket until the antenna is in a third orientation wherein the first and second digital levels produce a skew reading that corresponds to a predetermined skew reading;

retaining the antenna in the third orientation;

operating the set top box and television such that a series of tones are emitted from the television speaker which are indicative of the alignment of the antenna centerline with the satellite;

transmitting the series of tones to the audio speaker;

repositioning the first and second movable portions and the mast within the second movable portion as necessary to move the antenna to a final orientation wherein the series of tones being transmitted to the speaker affixed to the antenna have a desired frequency;

locking the mast to the second movable portion; and locking the first and second movable portions to prevent further movement thereof.

* * * * *